US011104168B2

(12) United States Patent
Sillipp et al.

(10) Patent No.: US 11,104,168 B2
(45) Date of Patent: Aug. 31, 2021

(54) STAMP, AN INK PAD AND A CLOSURE CAP

(71) Applicant: Trodat GmbH, Wels (AT)

(72) Inventors: Bernhard Sillipp, Krenglbach (AT); Bernd Langeder, Schleißheim (AT); Helmut Lindner, Peuerbach (AT)

(73) Assignee: Trodat GmbH, Wels (AT)

( * ) Notice: Subject to any disclaimer, the term of this patent is extended or adjusted under 35 U.S.C. 154(b) by 0 days.

(21) Appl. No.: 15/177,091

(22) Filed: Jun. 8, 2016

(65) Prior Publication Data

US 2016/0361935 A1 Dec. 15, 2016

(30) Foreign Application Priority Data

Jun. 10, 2015 (AT) ..... A 50475/2015

(51) Int. Cl.
*B41K 3/56* (2006.01)
*B41K 1/40* (2006.01)
(Continued)

(52) U.S. Cl.
CPC ..... *B41K 3/56* (2013.01); *B41K 1/40* (2013.01); *B41K 1/42* (2013.01); *B41K 1/54* (2013.01)

(58) Field of Classification Search
CPC ... B41K 1/00; B41K 1/02; B41K 1/36; B41K 1/42; B41K 1/56; B41K 3/56; B41K 1/04; B41K 1/38; B41K 1/40
See application file for complete search history.

(56) References Cited

U.S. PATENT DOCUMENTS 454,499 A 6/1891 Ryer
973,556 A 10/1910 Peterson
(Continued)

FOREIGN PATENT DOCUMENTS

AT 501318 11/2006
AT A50017/2014 1/2014
(Continued)

OTHER PUBLICATIONS

Co-Pending Design U.S. Appl. No. 29/548,144 entitled, "Hand Stamp" to Riegler et al., filed Dec. 10, 2015.
(Continued)

*Primary Examiner* — Jill E Culler
*Assistant Examiner* — Marissa Ferguson-Samreth
(74) *Attorney, Agent, or Firm* — Kowert, Hood, Munyon, Rankin & Goetzel, P.C.; Gareth M. Sampson

(57) ABSTRACT

In some embodiments, a stamp may include at least one stamping component and one stamping insert. The stamping component may be formed of a top part with a handle element and a bottom part with a cushion-receiving element. The stamping insert may be connected so as to move synchronously via a reversing mechanism having a slide track in the bottom part via an shaft or trunnion to the top part. In the resting position a text plate mounted on the stamping insert may abut against an ink pad soaked with ink in the cushion-receiving element. The stamping insert with the text plate can be shifted by the reversing mechanism into a stamping position. On the ink pad, a protective cover is located on that side on which a handle element is located on a support device of the ink pad. The system including an ink pad and a closure cap.

6 Claims, 28 Drawing Sheets

(51) Int. Cl.
*B41K 1/54* (2006.01)
*B41K 1/42* (2006.01)

(56) References Cited

U.S. PATENT DOCUMENTS

| | | | | |
|---|---|---|---|---|
| D331,418 | S | 12/1992 | Winston | |
| D359,504 | S | 6/1995 | Stefanski | |
| D367,879 | S | 3/1996 | Smith | |
| D387,800 | S | 12/1997 | Daw | |
| 5,694,844 | A | 12/1997 | Taira | |
| D389,175 | S | 1/1998 | Imamaki | |
| 5,727,467 | A | 3/1998 | Skopek | |
| 5,768,992 | A | 6/1998 | Daw et al. | |
| D400,566 | S | 11/1998 | Schreiberhuber | |
| 5,850,787 | A * | 12/1998 | Pichler | B41K 1/40 101/105 |
| 5,971,130 | A | 10/1999 | Nakamura | |
| D417,464 | S | 12/1999 | Skopek | |
| 6,067,905 | A | 5/2000 | Faber | |
| D451,944 | S | 12/2001 | Lipkin | |
| 6,732,649 | B1 | 5/2004 | Wall et al. | |
| 6,813,999 | B2 | 11/2004 | Treml | |
| 6,834,584 | B1 | 12/2004 | MacNeil | |
| 6,892,638 | B2 | 5/2005 | Sculler | |
| 7,069,852 | B2 * | 7/2006 | Zindl | B41K 1/54 101/104 |
| D538,328 | S | 3/2007 | Faber | |
| D540,848 | S | 4/2007 | Faber | |
| D542,335 | S | 5/2007 | Faber | |
| D542,835 | S | 5/2007 | Faber | |
| 7,389,727 | B2 * | 6/2008 | Faber | B41K 1/40 101/103 |
| D588,187 | S | 3/2009 | Shih | |
| 7,520,221 | B2 | 4/2009 | Ameshofer | |
| D618,274 | S | 6/2010 | Faber | |
| 7,743,703 | B2 | 6/2010 | Ameshofer | |
| 7,853,353 | B1 | 12/2010 | Hagen et al. | |
| 7,877,909 | B1 | 2/2011 | Hagen et al. | |
| 7,894,935 | B1 | 2/2011 | Hagen et al. | |
| D645,121 | S | 9/2011 | Fukasawa | |
| 8,050,796 | B1 | 11/2011 | Hagen et al. | |
| D668,714 | S | 10/2012 | Zindl | |
| D677,322 | S | 3/2013 | Zindl | |
| 8,402,890 | B2 | 3/2013 | Faber | |
| 8,408,126 | B2 | 4/2013 | Faber | |
| 8,413,357 | B1 | 4/2013 | Hagen et al. | |
| 9,227,450 | B2 * | 1/2016 | Faber | B41K 1/36 |
| 9,333,784 | B2 | 5/2016 | Faber et al. | |
| 9,354,630 | B2 | 5/2016 | Sukhman | |
| 9,475,326 | B2 | 10/2016 | Petersen | |
| 9,735,561 | B2 | 8/2017 | Schwarz et al. | |
| D803,307 | S | 11/2017 | Riegler et al. | |
| 9,895,919 | B2 | 2/2018 | Zehetner et al. | |
| D820,350 | S | 6/2018 | Riegler et al. | |
| D823,378 | S | 7/2018 | Riegler et al. | |
| D847,899 | S | 5/2019 | Riegler et al. | |
| 10,456,868 | B2 | 10/2019 | Pinot et al. | |
| 2001/0049669 | A1 | 12/2001 | Ito et al. | |
| 2003/0150343 | A1 | 8/2003 | Koneczny | |
| 2005/0066828 | A1 | 3/2005 | Wei | |
| 2006/0000374 | A1 | 1/2006 | Faber | |
| 2006/0000376 | A1 | 1/2006 | Faber et al. | |
| 2006/0162596 | A1 * | 7/2006 | Faber | B41K 1/42 101/333 |
| 2006/0185539 | A1 * | 8/2006 | Faber | B41K 1/40 101/333 |
| 2007/0272099 | A1 * | 11/2007 | Pointl | B41K 1/40 101/104 |
| 2008/0087180 | A1 | 4/2008 | Ameshofer | |
| 2009/0255427 | A1 | 10/2009 | Faber | |
| 2009/0301327 | A1 | 12/2009 | Nelson | |
| 2010/0031835 | A1 | 2/2010 | Faber | |
| 2010/0263561 | A1 | 10/2010 | Faber | |
| 2011/0277647 | A1 * | 11/2011 | Zindl | B41K 1/006 101/334 |
| 2011/0313561 | A1 | 12/2011 | Lee | |
| 2013/0291744 | A1 | 11/2013 | Anthony | |
| 2015/0181033 | A1 | 6/2015 | Keller | |
| 2016/0325381 | A1 | 11/2016 | Pinot et al. | |
| 2016/0361934 | A1 | 12/2016 | Riegler et al. | |
| 2016/0361935 | A1 | 12/2016 | Sillipp et al. | |
| 2016/0361936 | A1 | 12/2016 | Zehetner et al. | |
| 2016/0368297 | A1 | 12/2016 | Scharinger et al. | |
| 2019/0299690 | A1 | 10/2019 | Leibezeder et al. | |

FOREIGN PATENT DOCUMENTS

| | | |
|---|---|---|
| AT | A50473/2015 | 6/2015 |
| AT | A50474/2015 | 6/2015 |
| AT | A50475/2015 | 6/2015 |
| AT | A50478/2015 | 6/2015 |
| CA | 2717256 | 11/2011 |
| CN | 301153224 | 3/2010 |
| CN | 304057436 | 2/2017 |
| CN | 304057437 | 2/2017 |
| DE | 1654769 | 4/1953 |
| DE | 202010007577 U | 8/2010 |
| DE | 102014210611 | 12/2015 |
| EM | 001922865-0001 | 2/2012 |
| EM | 002716431-0001 | 1/2017 |
| EM | 002716431-0011 | 1/2017 |
| EM | 002904854-0007 | 1/2017 |
| EP | 0459969 | 12/1991 |
| EP | 0804344 B1 | 9/1998 |
| EP | 2384283 B1 | 11/2011 |
| EP | 2591921 B1 | 5/2013 |
| EP | 2594406 | 5/2013 |
| JP | 2008042032 | 2/2008 |
| JP | D1546014 | 3/2016 |
| WO | 1999064246 | 12/1999 |
| WO | 2004085110 | 10/2004 |
| WO | 2006029422 | 3/2006 |
| WO | 2006079129 | 8/2006 |
| WO | 2006079131 | 8/2006 |
| WO | 2010085828 | 8/2010 |
| WO | 2011056345 | 5/2011 |
| WO | 2011151604 | 12/2011 |
| WO | 2014113833 | 7/2014 |
| WO | 2014/172738 A1 | 10/2014 |
| WO | 2014172738 | 10/2014 |
| WO | 2015103654 | 7/2015 |
| WO | 2015176089 | 11/2015 |
| WO | 2016/197172 | 12/2016 |
| WO | 2016197170 | 12/2016 |
| WO | 2016197171 | 12/2016 |
| WO | 2016197173 | 12/2016 |
| WO | 2017210711 | 12/2017 |
| WO | 2018064692 | 4/2018 |

OTHER PUBLICATIONS

Co-Pending Design U.S. Appl. No. 29/567,664 entitled, "Hand Stamp" to Riegler et al., filed Jun. 10, 2016.

Co-Pending Design U.S. Appl. No. 29/567,665 entitled, "Stamp Pad" to Riegler et al., filed Jun. 10, 2016.

Co-Pending Design U.S. Appl. No. 29/567,666 entitled, "Hand Stamp" to Riegler et al., filed Jun. 10, 2016.

NPL02—Registered Community Design No. 002716431, registered Community design for hand stamp and pad, Jun. 10, 2015, 86 pages.

NPL03—Written Opinion for PCT/AT2015/050003 dated Sep. 11, 2015. (publication No. WO2015103654).

NPL04—International Search Report for PCT/AT2015/050003 dated Dec. 11, 2015. (publication No. WO2015103854).

NPL05—Registered Community Design No. 002904854, registered Community design for hand stamp and pad, Dec. 10, 2015, 23 pages.

NPL06—Amazon. <URL: https://www.amazon.com/dp/B01MQDH576?psc=1.> Nov. 3, 2016. Self-inking stamp.

NPL07—Amazon. <URL: http://a.co/3GHpXYC.> Feb. 12, 2013. Self-inking stamp.

(56) References Cited

OTHER PUBLICATIONS

NPL08—Amazon. <URL: https://www.amazon.com/Replacement-TRODAT-Printy-I nkinguStamps/dp/BOOFB70JEO/ref=sr_ 1_ 1 ?ie=UTF8&qid=1496770907&sr=8-1 &keywords=Replacement+Ink+Pad.> Feb. 11, 2012. Replacement Ink Pad.
NPL09_Universal Laser Systems, Inc., "The Turnkey Laser Personalization and Identification Program," 2000.
Notice of Allowance for U.S. Appl. No. 29/567,664 dated Jul. 12, 2017.
Non Final Office Action for U.S. Appl. No. 29/567,665 dated Jun. 29, 2017.
Non Final Office Action for U.S. Appl. No. 29/567,666 dated Jun. 30, 2017.
Non Final Office Action for U.S. Appl. No. 15/177,072 dated Mar. 27, 2017.
Non Final Office Action for U.S. Appl. No. 15/177,078 dated Mar. 31, 2017.
Non Final Office Action for U.S. Appl. No. 15/177,091 dated Mar. 31, 2017.
NPL10—Communication for U.S. Appl. No. 29/567,665 dated Jan. 3, 2018.
Final Office Action for U.S. Appl. No. 15/177,072 dated Oct. 11, 2017.
Advisory Action for U.S. Appl. No. 15/177,072 dated Dec. 27, 2017.
Final Office Action for U.S. Appl. No. 15/177,078 dated Oct. 20, 2017.
Notice of Allowance for U.S. Appl. No. 15/177,100 dated Oct. 19, 2017.
Notice of Allowance for U.S. Appl. No. 29/548,144 dated Mar. 19, 2018.
Notice of Allowance for U.S. Appl. No. 29/567,665 dated Mar. 19, 2018.
Final Office Action for U.S. Appl. No. 29/567,666 dated Feb. 26, 2018.
Advisory Action for U.S. Appl. No. 15/177,078 dated Feb. 21, 2018.
Advisory Office Action for U.S. Appl. No. 15/177,091 dated Jan. 19, 2018.
Non Final Office Action for U.S. Appl. No. 15/177,091 dated Mar. 27, 2018.
Final Office Action for U.S. Appl. No. 15/177,091 dated Oct. 5, 2017.
Advisory Action for U.S. Appl. No. 29/567,666 dated May 29, 2018.
Non Final Office Action for U.S. Appl. No. 15/177,072 dated Apr. 6, 2018.
Non Final Office Action for U.S. Appl. No. 15/177,078 dated Jun. 14, 2018.
Notice of Allowance for U.S. Appl. No. 29/567,666 dated Dec. 12, 2018.
Final Office Action for U.S. Appl. No. 15/177,072 dated Sep. 14, 2018.
Advisory Action for U.S. Appl. No. 15/177,072 dated Nov. 23, 2018.
Notice of Allowance for U.S. Appl. No. 15/110,610 dated Sep. 25, 2018.
NPL13—International Search Report for PCT/AT2017/060146 dated Jan. 15, 2019. (publication No. WO2017210711).
NPL15—Written Opinion for PCT/AT2017/060146 dated Jan. 15, 2019. (publication No. WO2017210711).
NPL14—International Preliminary Report on Patentability for PCT/AT2017/060146 completed Sep. 5, 2018. (publication No. WO2017210711).
NPL11—Written Opinion for PCT/AT2017/060237 dated Mar. 23, 2018. (publication No. WO2018064692).
NPL12—International Search Report for PCT/AT2017/060237 dated Mar. 23, 2018. (publication No. WO2018064692).
Co-Pending U.S. Appl. No. 15/177,072 entitled, "Stamping Device and Stamping Insert, Especially as a Replacement Part for a Stamping Device" to Scharinger et al., filed Jun. 8, 2016.
Co-Pending U.S. Appl. No. 15/177,078 entitled, "Stamp and Stamping Insert, Especially as a Replacement Part for a Stamp" to Riegler et al., filed Jun. 8, 2016.
Co-Pending U.S. Appl. No. 15/177,078 entitled, "Stamp and Stamping Insert, Especially as a Replacement Part for a Stamp" to Riegler et al., filed Apr. 27, 2020.
Co-Pending U.S. Appl. No. 15/177,100 entitled, "Stamp and Stamping Insert" to Zehetner et al., filed Jun. 8, 2016.
Notice of Allowance for U.S. Appl. No. 15/177,072 dated Jan. 14, 2020.
Notice of Allowance for U.S. Appl. No. 15/177,078 dated Dec. 27, 2019.
Non-Final Office Action for U.S. Appl. No. 16/859,690 dated Jun. 29, 2020.
International Preliminary Report on Patentability for PCT/AT2017/060237 dated Apr. 9, 2019. (publication No. WO2018064692).

* cited by examiner

STAMP, AN INK PAD AND A CLOSURE CAP

PRIORITY CLAIM

This application claims priority to Austrian Patent Application No. A50475/2015 entitled "Zusatzkomponente" filed on Jun. 10, 2015, all of which is incorporated by reference herein.

BACKGROUND OF THE INVENTION

1. Field of the Invention

The invention relates to a stamp, an ink pad and a closure cap.

2. Description of the Relevant Art

From EP 0804344 B1, a stamping device with top inking, also known as self-inking stamp, is known that has a receiving frame made of metal for a stamping insert, which is guided in lateral parts of the receiving frame. The receiving frame supports a bottom part made of plastic. The stamping insert is adjustable via a reversing mechanism from a resting position, in which ink is adsorbed from a cushion placed in an ink pad, to an imprinting position against a spring force by a bow-shaped top part. The bow-shaped top part in turn comprises a metal reinforcement bracket on the inside. Furthermore, in the middle of the bow-shaped top part and in the center of the bottom part, on both sides of the bow spring elements are positioned for returning the top part to the resting position. For fixation of the top part relative to the bottom part, latching elements are arranged in the bottom part that engage in a recess on the outside of the bow-shaped top part.

Such a design of a self-inking stamp by the Applicant differs from the prior art, such as US 2009/0255427 A, AT 501318 B and DE 202010007577 U, by the absence of a central strut between the top part and bottom part. In the prior art, the central strut accommodates the spring element, so that on the lateral parts of the bow-shaped top part now no spring elements are arranged anymore. In this prior art, the element cannot be described as a bow-shaped top part either, since the central strut forms a central bar to the two lateral bars. The disadvantage of a self-inking stamp with central strut is that there is no space for integrating a viewing window, and thus the replica of the stamp image is arranged with an offset and extends to the lateral surface of the bottom part.

SUMMARY

An object of the present invention is to provide a stamp, an ink pad, a closure cap and a transport system for a stamp band and a method in which improved stability of the stamp parts for increasing the print quality is provided. At the same time a simple design is to be achieved. Another object is to allow customization of the stamp as late as possible.

An object of the invention is, however, also achieved by a stamp, especially a self-inking stamp, in which on the ink pad a protective cover is located on that side on which a handle element is located on a support device of the ink pad, wherein the protective cover extends in the direction of the contact area of the stamp.

The advantage here is that thereby reliable protection from soiling is achieved, since e.g. during adjustment of the mounted band unit, particularly the date, the user's finger can no longer come into contact upwards with the ink-soaked pad, as it abuts against the protective cover. Such a protective cover has been developed insofar, since in the stamp according to the present invention the cushion-receiving element for the ink pad is designed to be open downwards towards the contact area, while in the prior art here a channel-shaped opening is present, into which the ink pad is pushed in. Another advantage is that when handling the ink pad the user can no longer slide a finger over the handle element of the ink pad into the open area, and hence a further danger of soiling is prevented.

In an advantageous embodiment the protective cover is formed over the entire longitudinal side of the ink pad and protrudes beyond an upper edge of the support device for the ink pad impregnated with ink. Thus, reliable protection is afforded in every position.

In another advantageous embodiment, in the area of the cushion-receiving element the bottom part of the stamp is formed to be open in the direction of the stamping insert, where the ink pad is arranged on guide bars on the sides of the bottom part. Thus the weight of the stamp can be reduced, facilitating the handling for the user.

In another advantageous embodiment, in the cushion-receiving element over at least a partial area an angular surface is provided, having attached a means for fastening of an ink pad. This ensures that secure attachment and positioning are achieved by the effect of horizontal and vertical forces on the ink pad, as can be seen in detail from the previously patented system.

An object of the invention is achieved also by an ink pad for a stamp, in particular a self-inking stamp, in which the ink pad comprises, on that longitudinal side on which the handle element is arranged, a protective cover which extends along the upper edge of the open support device.

The advantage here is that thanks to the protective cover the user cannot slip into the ink-soaked cushion when removing the pad from the stamp or inserting it into the stamp. Another advantage is that with the inking pad inserted the protective cover, in particular the edge of the protective cover, forms an obstacle to the finger, so that during the handling of the stamp there is no involuntary contact with the pad.

In an advantageous embodiment the protective cover is formed over the entire longitudinal side of the ink pad and protrudes beyond an upper edge of the support device for the ink pad impregnated with ink. Thus, the entire rear side of a cushion-receiving element of the stamp can be easily covered.

In yet another advantageous embodiment, in the supporting element over at least a partial area an angular surface is provided, having attached a means for fastening of an ink pad. Thereby, an already armed system for securing and positioning of the ink pad is used in the stamp.

An object of the invention is, however, also achieved by a closure cap for a stamp, in particular a self-inking stamp, in which the bonnet can be fitted onto a bottom part of a stamp and the side walls are formed for fixing to the stamp.

The advantage here is that already the closure cap can be fitted, in case of an appropriate embodiment of the shape with the taper in the central region, onto the stamping component without a stamping insert being inserted, as the shape of the closure cap holds the stamping component in position. Preferably, however, the closure cap with mounted stamping insert is used, so that an appropriately improved retention system is used. For the first time a closure cap was developed for a self-inking stamp in which the stamp is held in the stamping position or closure cap position in which the text plate is lifted off the cushion.

Another advantageous embodiment is a design in which on the stamping insert on the opposite side to the text plate at least one retention element is arranged. This ensures that reliable fixation in the stamping position or closure cap position, respectively, is achieved.

In another advantageous embodiment the closure cap can be pushed on via a lateral surface of a stamping component. This ensures that the positioning is achieved by simple fitting.

However, in another advantageous embodiment the closure cap comprises a bonnet, in which preferably on either side a recess is located. This ensures that when the closure cap is placed on the stamp the user can easily grasp the closure cap via the recesses with the thumb and forefinger and push it sideways out of the stamp.

In another advantageous embodiment, the closure cap comprises a bearing surface for the contact area or the frame. This ensures that the stamping component, in particular the contact elements or the frame, are positioned at defined points.

In a final advantageous embodiment, the text plate of the stamp in the interior of the closure cap is arranged at a distance from the closure cap when the closure cap is put on. This ensures that the text plate is protected by the closure cap.

The invention is described hereinafter in the form of exemplary embodiments, wherein attention is drawn to the fact that the invention is not limited to the exemplary embodiments or solutions represented and described.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
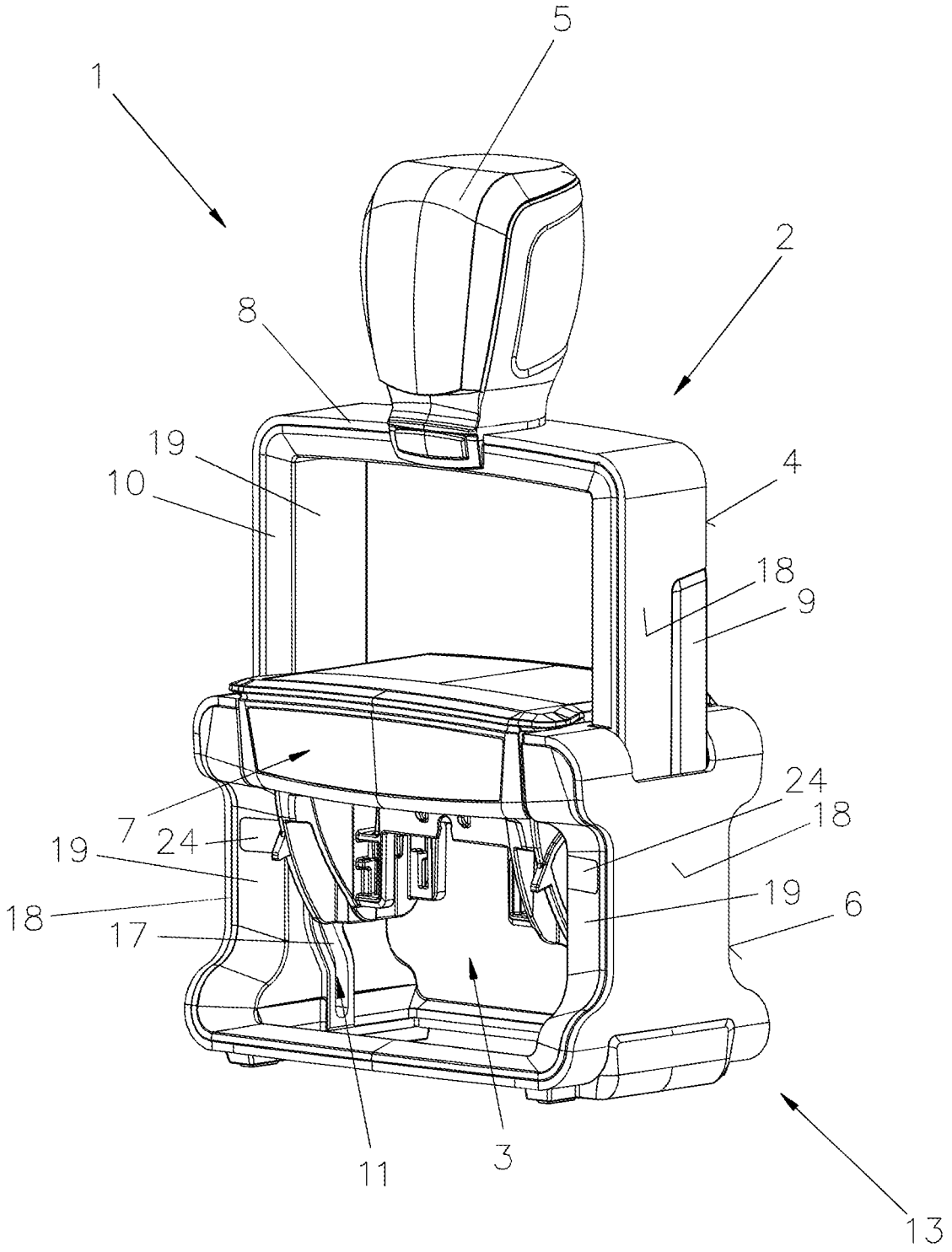
FIG. 1—schematic illustration of a stamp, particularly a self-inking stamp, in a resting position; simplified, for illustrative purposes only.
Figure 2:
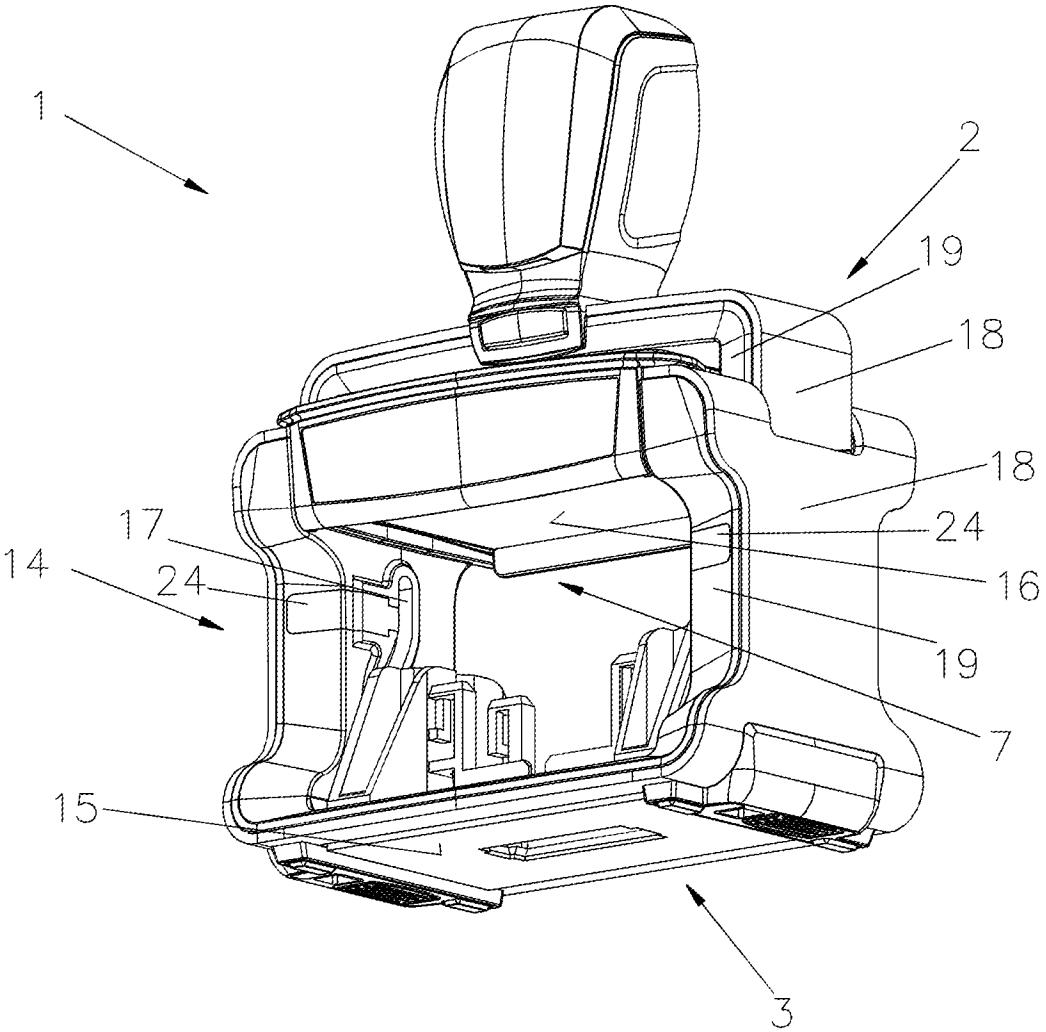
FIG. 2—schematic illustration of the stamp in a printing or impression position, respectively; simplified, for illustrative purposes only.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. For example, a "third die electrically connected to the module substrate" does not preclude scenarios in which a "fourth die electrically connected to the module substrate" is connected prior to the third die, unless otherwise specified. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task (e.g., a set of electrical conductors may be configured to electrically connect a module to another module, even when the two modules are not connected). In some contexts, "configured to" may be a broad recitation of structure generally meaning "having circuitry that" performs the task or tasks during operation. As such, the component can be configured to perform the task even when the component is not currently on. In general, the circuitry that forms the structure corresponding to "configured to" may include hardware circuits.

Various components may be described as performing a task or tasks, for convenience in the description. Such descriptions should be interpreted as including the phrase "configured to." Reciting a component that is configured to perform one or more tasks is expressly intended not to invoke 35 U.S.C. § 112, paragraph six, interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

It is to be understood the present invention is not limited to particular devices or biological systems, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

DETAILED DESCRIPTION

Definitions

Unless defined otherwise, all technical and scientific terms used herein have the same meaning as commonly understood by one of ordinary skill in the art.

The term "connected" as used herein generally refers to pieces which may be joined or linked together.

The term "coupled" as used herein generally refers to pieces which may be used operatively with each other, or joined or linked together, with or without one or more intervening members.

The term "directly" as used herein generally refers to one structure in physical contact with another structure, or, when used in reference to a procedure, means that one process affects another process or structure without the involvement of an intermediate step or component.

Embodiments

It should be stated by way of introduction that, in the individual embodiments, the same parts are provided with the same reference numbers or same component designations, wherein the disclosures contained in the entire description can, by analogy, be transferred to same parts with same reference numbers or same component designations. The position details selected in the description, such as, e.g., top, bottom, lateral, etc., relate to the figure described, and in the event of a change of position, they are to be transferred to the new position by analogy. Individual features or feature combinations from the exemplary embodiments shown and described may also represent independent inventive solutions.

In FIGS. 1-24, a stamp 1, in particular a self-inking stamp 1 is shown, comprising at least one stamping component 2 and one stamping insert 3.

The stamping component 2 consists at least of a top part 4 having a handle element 5 and a bottom part 6 with a cushion-receiving element 7. The top part 4 is preferably bow-shaped and comprises one longitudinal bar 8 and two lateral elements 9,10, where the lateral elements 9,10 are guided in the bottom part 6. The stamping insert 3 is connected via a reversing mechanism 11, in the bottom part 6 connected so as to move synchronously to the top part 4 via a shaft 12 and a swivel pin 12, so that the stamping insert 3 in the bottom part 6 can move from a resting position 13, according to FIG. 1, into a printing or stamping position 14, according to FIG. 2, upon actuation of the top part 4, in particular in particular upon exertion of pressure on the handle element 5. Of course, a different design is possible in which the top part 4 is cap-shaped and during a stamping operation receives the bottom part 6 in its interior, as this is the case in plastic self-inking stamps, e.g. the "Printy4.0" by the company Trodat described in WO 2010/085828 A2 which is incorporated fully herein. In the resting position 12, a text plate 15 mounted on the stamping insert 3 abuts against an ink pad soaked with stamp ink 16 in the cushion-receiving element 7, wherein during a stamping process for producing a stamp impression the stamping insert 3 with the text plate 15 is adjustable or is adjusted via the reversing mechanism 11 from the resting position 13 by a rotational movement into the stamping position 14, i.e., the stamping insert 3 is rotated around the shaft 12, for which the reversing mechanism 11 serves, in which along a predetermined slide track 17 a rotation of the stamping insert 3 is performed. Such reversing mechanisms 11 and rotational movements are known from self-inking stamps of this type 1, so they will not be described in more detail. It is merely pointed out that in the stamp 1 according to the invention a rigid slide track 17 is shown, but alternatively a movable slide track (not shown) may be employed. Of course, an equivalent design of the components with a so-called central strut, as it is known from the prior art, would also be possible, i.e. the same or equivalent parts are used, but an additional central strut is used, in which a spring for resetting into the resting position 13 is arranged, where in the illustrated stamp 1 in the lateral bar 8, 9 and bottom part this 6 is arranged.

In the illustrated stamp 1, a combination of metal parts 18 and plastic parts 19 is used, where the metal parts 18 are arranged to be externally visible. The metal parts 18 are thereby pushed over the plastic parts 19 and latch via a latch connection, so that upon pressurization the metal parts 18 absorb some of the pressure, i.e., the metal parts 18 support the plastic parts 19 in their rigidity, so that no bending of parts is possible and thus optimum impression with very high print quality is achieved.

The advantage for the use of a metal/plastic combination is that the plastic parts 19 can be dimensioned smaller in terms of wall thickness, because the metal parts 18 also absorb a part of the acting forces.

The design of the stamp 1 shown is in the form of a kit for the stamping component 2, i.e., the same parts of the stamping components 2 are used for the various versions of the stamp 1, such as self-inking stamp 1 with a text plate as well as self-inking stamp 1 with a mounted band unit 19, where customization takes places only by insertion of the stamping insert 3.

Figure 3:
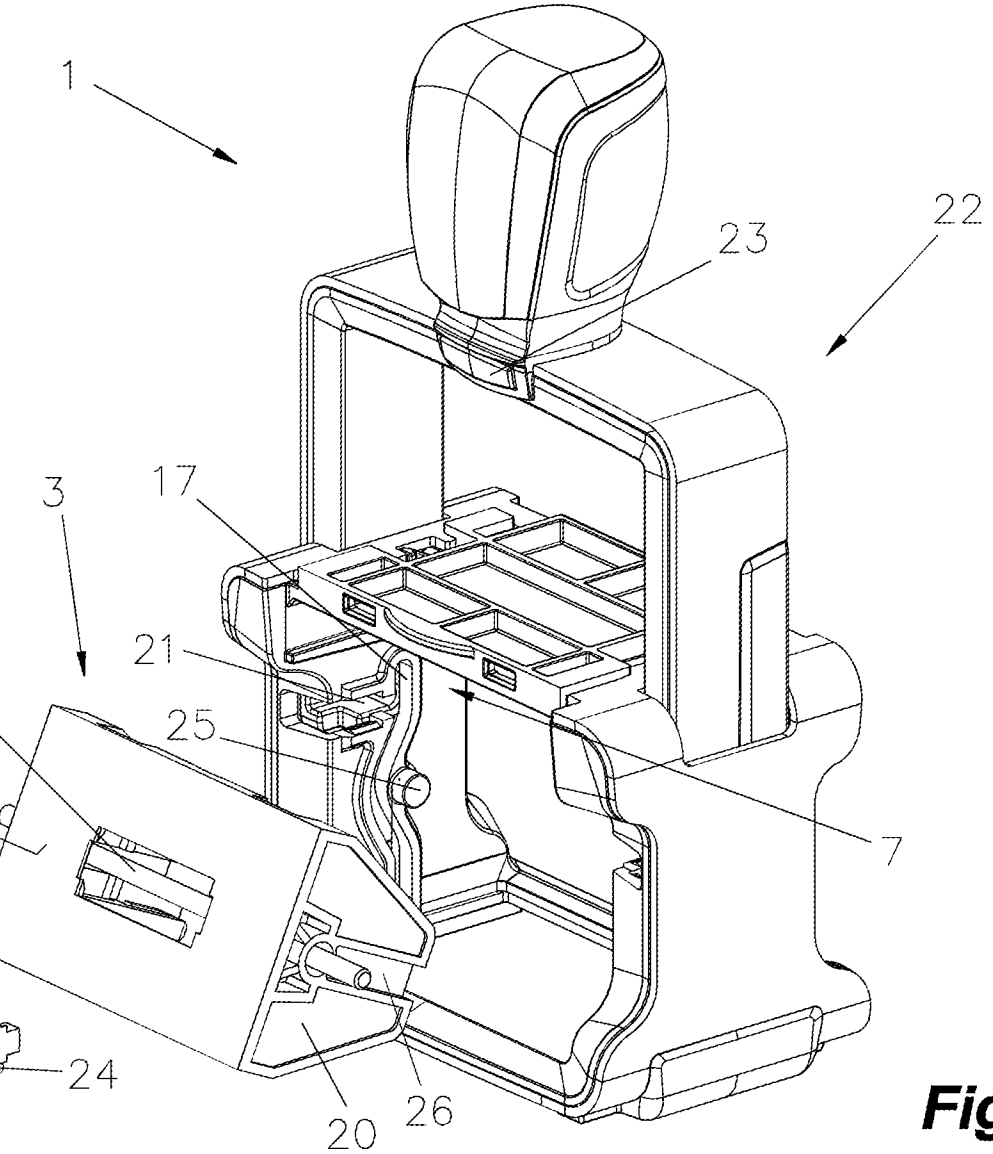
FIG. 3—schematic illustration of the stamp in an interchange position for inserting or replacing a stamping insert; simplified, for illustrative purposes only.
Figure 4:
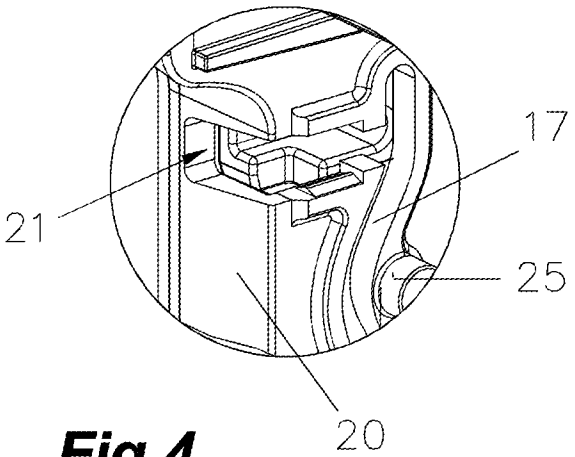
FIG. 4—enlarged schematic illustration of the interchange position of the stamping insert.

Such a solution according to the present invention for customizing the stamp 1 is shown in detail in FIGS. 3 and 4, where the entire stamping insert 3, in particular a text plate carrier 20 and/or the date unit or mounted band unit 19, with the shaft 12 or the trunnions or stub shafts 12, is arranged interchangeably, i.e. unlike what is known from the prior art, where individual parts, especially the mounted band unit 19 or the text plate 15, are arranged so as to be exchangeable with the text plate carrier 20 remaining within the stamp 1, by contrast in the inventive solution, the entire text plate carrier 20 with the shaft 12 or trunnions or stub shafts are exchangeable.

To make this possible, the slide track 17 of the reversing mechanism 11 comprises an exchange channel 21 in the bottom part 6. In the illustrated exemplary embodiment, this exchange channel 21 is arranged in the top part adjacent to the cushion-receiving element 7, which position corresponds to the interchange position 22 or replacement position for the ink pad 16 and the stamping insert 3, respectively, i.e. in this position the stamp can be locked via a latch 23, so that it is no longer automatically returned to the resting position 13, and thus the stamping insert 3 and/or the ink pad 16 can be can be exchanged easily, without having to hold the stamp 1 in this position. Of course it is possible to have another specific interchange position 22 formed for the stamping insert 3 on the stamp 1, wherein another advantageous position has been found to be the end of the slide track 17 in the stamping position 14, since here the stamping insert 3 can be exchanged downwards. Preferably, the exchange channel 21 is arranged in the upper region, in particular in a perpendicular section of the slide track 17, so that easy interruption of the slide track 17 is possible and the risk of tilting of the shaft 12 in the transition from the slide track 17 to the exchange channel 21 is as low as possible. Furthermore, it is achieved that the interchange position 22 and thus the position of the exchange channel 21 is arranged so that for the exchange of the text plate carrier 20 the text plate 15 provided at the text plate carrier 20 is lifted off the ink pad 16. Here the exchange channel 21 runs in the top part at an angle of 90° to the perpendicular end part of the slide track 17, i.e. the 90° arrangement of the exchange channel 21 to the slide track 17 avoids the danger that during the stamping operation the stamping insert 3 can independently slide into the exchange channel 21 or be deflected.

Thus is it the case that for insertion of the stamping insert 3, the stamping component 2 comprises an interchange position 22, where the shafts or trunnions 12 are associated with the exchange channel 21 and hence the shafts 12 or trunnions 12 can be led through the exchange channel 21 to the outside or into the stamping component 2. To prevent the stamping insert 3 from slipping out of the slide track 17 during a stamping operation, it is provided that the exchange channel 21 can be closed by a closure cap 24. Here thus without the closure cap 24 the slide track 17 is interrupted by the exchanging channel 21, and with the closure cap 24 attached, the slide track 17 is circumferentially closed, i.e., the end of the closure cap 24 is designed so that it matches the course of the slide track 17, so that in the inserted state the slide track 17 is completely closed.

Furthermore, on the bottom part 6 or the reversing mechanism 11 guide pins 25 are arranged for a receiving guide 26 on the text plate carrier 20. Here upon insertion of the stamping insert 3 in the illustrated exemplary embodiment first the stamping insert 3 is slid onto the guide pin 25 in such a manner that the same slides in a receiving guide 26, whereupon the stamping insert 3 with the laterally protruding shafts 12 or trunnions 12 is introduced via the exchange channel 21 with a slight rotating motion until the shafts 12 or trunnions abut against the slide track 17. Thereafter, the closure caps 24 may can be inserted. The stamping insert 3 is removed in the reverse order of steps.

In the illustrated exemplary embodiment of the invention according to FIGS. 3 and 4, replacement of the entire stamping insert 3 with the shaft 12 or trunnions 12 is described, where the slide track 17 is interrupted in such a manner that it can be closed, and in an interchange position 22 the stamping insert 3 can be pulled out or inserted via the exchange channel 21. Of course, it is possible that the interchange position 22 or the exchange channel 21, respectively, opens into the slide track 17 or is connected to the same, respectively, at any point so as to exchange the stamping insert 3, in particular the text plate carrier 20, with the shaft 12 or the trunnion 12.

Figure 6:
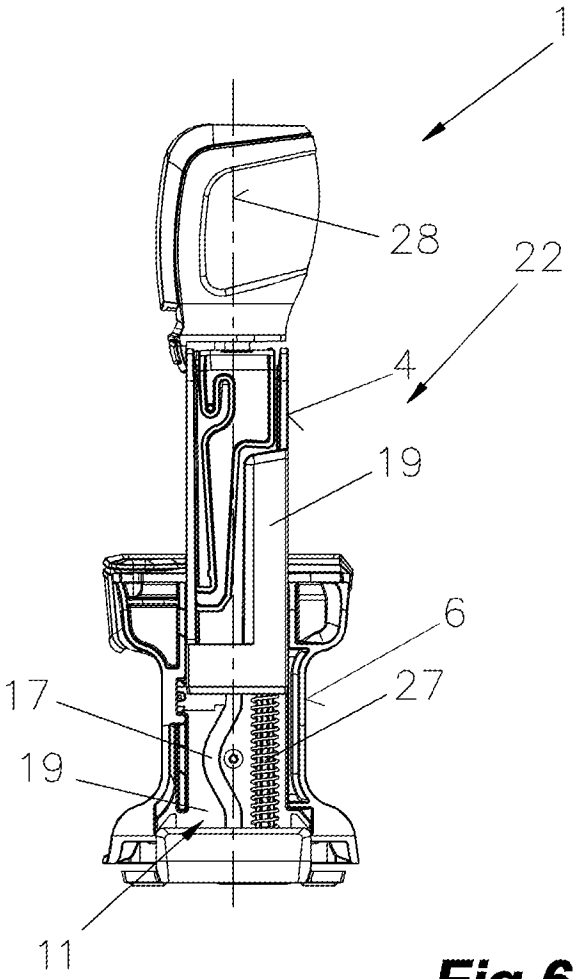
FIG. 6—lateral view of the stamp of FIG. 5; simplified, for illustrative purposes only.
Figure 5:
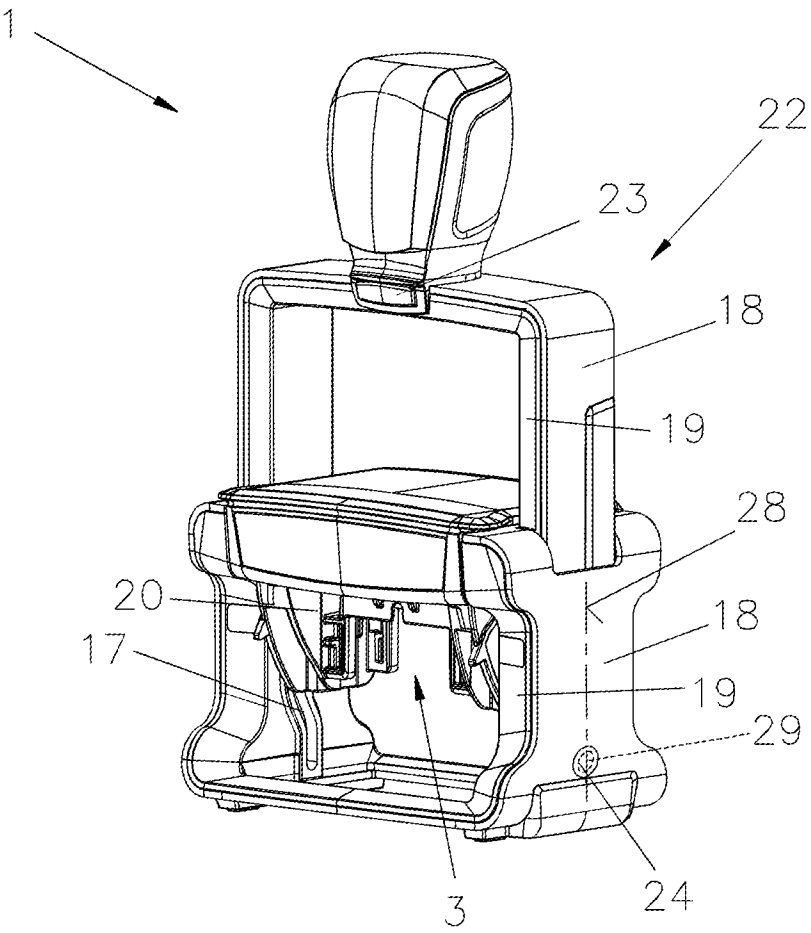
FIG. 5—schematic illustration of the stamp with metallic components in the resting position and a shaft replacement opening in a printing position; simplified, for illustrative purposes only.

In FIGS. 5 and 6, however, an exemplary embodiment is described in which the exchange of the stamping insert 3 can be carried out without interruption of the slide track 17. However, it is necessary that the shaft 12 or trunnion 12, respectively, can be mounted or removed, respectively, independently of the stamping insert 3. In FIG. 6, the stamping component 2 is shown without metal parts 18, in order to be able to show the interior of the design. As is clearly visible in FIG. 6, a spring element 27 present for resetting is located outside of a center 28 (shown with dotted-dashed lines) of the top part 4 and/or bottom part 6, wherein on the bow-shaped top part 4 and bottom part 6, particularly in the metal parts 18 of the top part 4 and/or bottom part 6, a closable shaft replacement opening 29 for a continuous shaft 12 or two trunnions 12 is arranged for subsequent installation of the text plate holder 20. Thus it is now possible that with appropriate positioning of the stamping component 2 in the corresponding interchange position 22, the shaft 12 can be pushed in and out through the shaft replacement opening 29, i.e. during the assembly the stamp 1 is placed in the interchange position 22, whereupon the stamping insert 3 is first positioned in the bottom part 2 and then the shaft 12 is pushed through from the outside through the shaft replacement opening 29 and the stamping insert 3, and the shaft replacement opening 29 is closed using a closure cap 24, where during disassembly after positioning in the interchange position 22 the closure caps 24 are removed, whereupon the shaft 12 is pushed to the outside by the stamping component 2, so that the stamping insert 3 can be removed after removing the shaft 12. It is also possible that no separate closure cap 24 is used, but that the shaft replacement opening 29 is positioned in such a matter that it is closed with a component of the stamp 1. In this embodiment, preferably for the interchange position 22 a corresponding locking position is provided, which is activated via the latch 23.

Due to the arrangement of the spring element 27 outside of the center 28, the slide track 17 of the reversing mechanism 11 can be positioned in the middle 28, allowing a simple structure for the stamping component 2, in particular for the rotational movement of the reversing mechanism 11. Thus, even replacement of the stamping insert 3 is possible, since the spring element 27 does not cover the shaft 12 in the slide track 17, as this is the case in the prior art in such designs with a bow-shaped top part 4 without a central strut.

However, there is also an embodiment (not shown) possible in which the spring element 27 is arranged in the center 28, but the slide track 17 of the reversing mechanism 11 and thus the shaft 12 is provided outside the middle 28. At the same time, correspondingly the shaft replacement opening 29 is arranged along the slide track 17, so that the shaft 12 can be pushed in and out, so that the replacement opening 29 is likewise located outside the center 28.

In the two exemplary embodiments of FIGS. 3 to 6 it is advantageous that the stamping component 2 can be fully completed without the stamping insert 3, where the customization of the stamp 1 is then carried out by inserting the corresponding stamping insert 3 with or without mounted band unit 19. Another advantage in the assembly of the text plate 15 lies with the stamping insert 3, as this can easily be done outside the stamp 1, in particular the stamping component 2, directly on the stamping insert 3.

Figure 7:
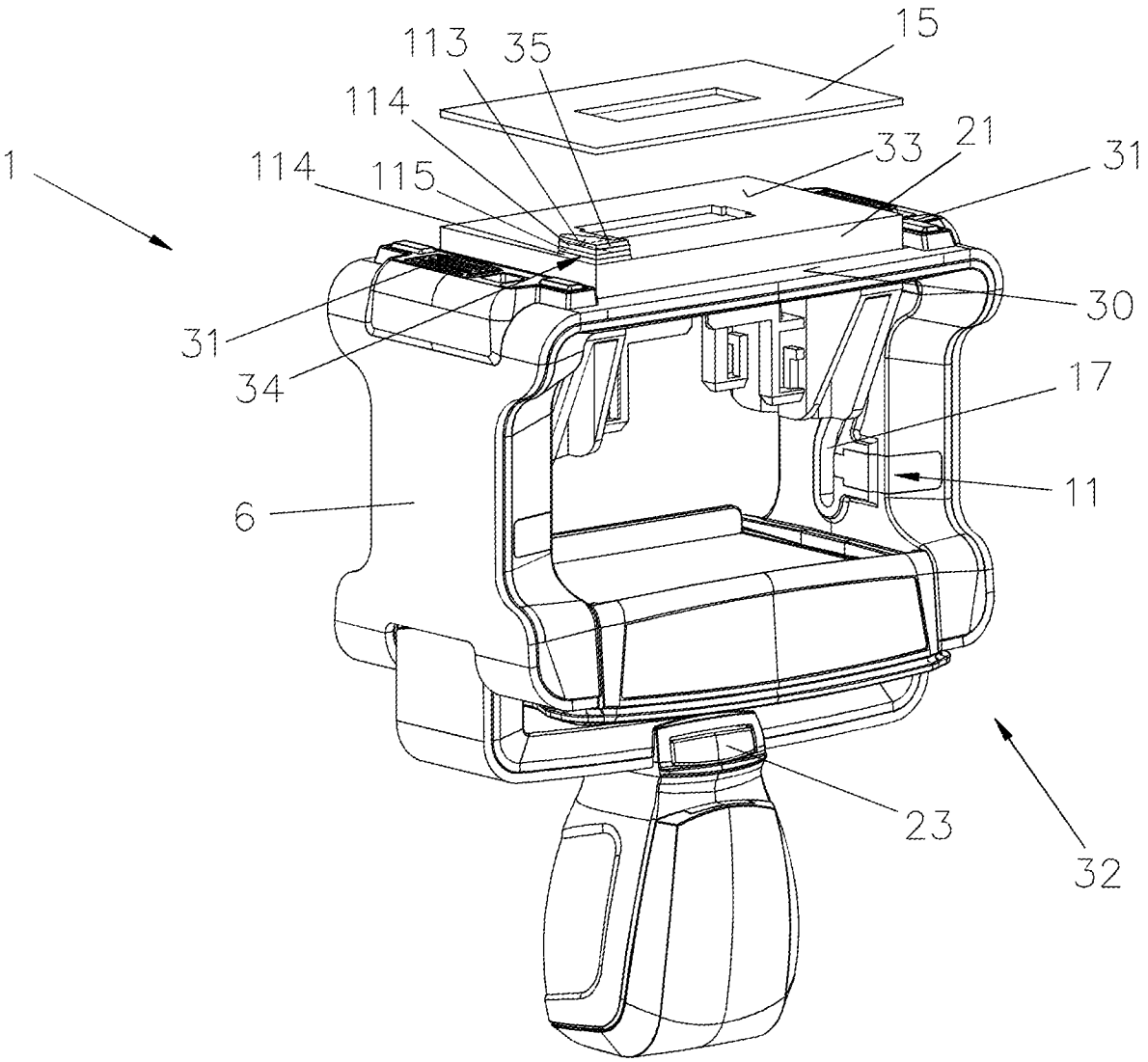
FIG. 7—schematic illustration of the [stamp] in compressed state in a text plate mounting position; simplified, for illustrative purposes only.

However, if a stamping component 2 is used, in which for example the stamping insert 3 cannot be easily retrofitted or disassembled, the handling of the assembly of the text plate 15 can be considerably simplified according to the exemplary embodiment of the invention in FIG. 7.

For this purpose, the slide track 17 of the reversing mechanism 11 is configured so that in the compressed state the text plate carrier 21 is arranged over a frame 30 of the bottom part 6 and/or a contact surface 31 of the stamp 1. Here this position preferably a locking position, in particular an assembly position 32, is assigned for fixation of the text plate 15 via the latch 23, i.e. the stamp 1 is compressed to the end stop of the slide track 17, i.e. the end of the slide track 17, so subsequently a text plate mounting surface 33 of the text plate carrier 21 protrudes over the frame 30 and/or the contact area 31, and the stamping component 2 can be fixed in this position by engaging the latch 23. Thanks to the protrusion over the text plate mounting surface 33, it is now easily possible that from already applied double-sided adhesive tapes 34 a protective film 35, as schematically indicated, can be removed, as lateral access to the protective film 35 is easily possible. At the same time, the alignment of the text plate 15 for pasting on is simplified, since no bars, frame 30 or parts of the stamp 1 interfere with the handling.

Naturally, it is also possible that this design can also be used with the previously described FIGS. 1 to 6, in particular in subsequent customization by appropriate insertion of various stamping inserts 3. Furthermore, the latch 23 (preferably a self-releasing) is used in the solution according to the present invention to simplify the installation of the text plate 15, i.e. after locking of the stamping component 2 in the assembly position 32 the user or stamp maker briefly compresses the stamp 1 once more, whereby the latch 23 releases and the stamping component 2 moves back into the resting position 13.

Figure 8:
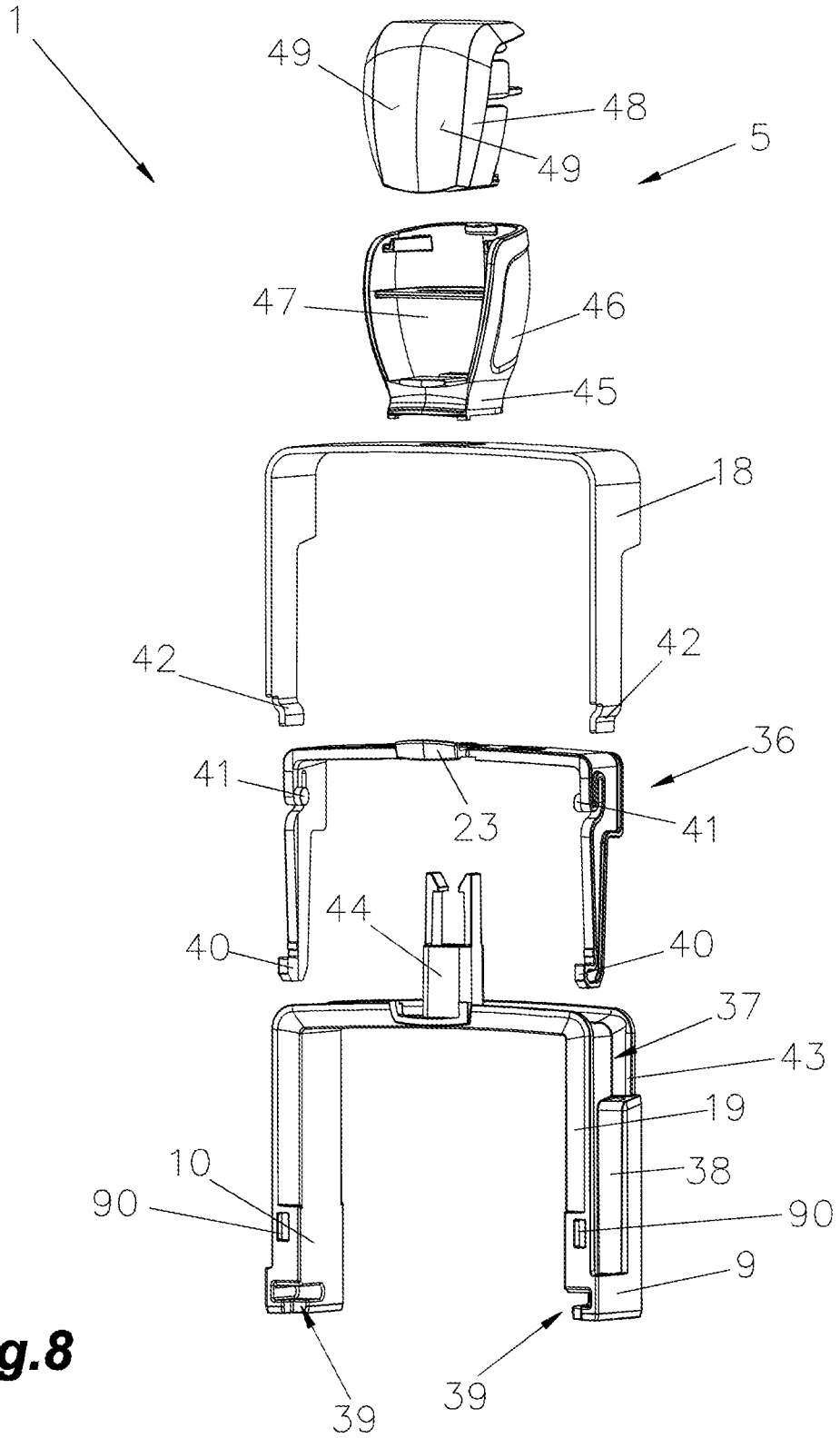
FIG. 8—exploded view of the stamp, especially the top part with a centrally positioned latch; simplified, for illustrative purposes only.

In order to enable the bow-shaped stamp 1 of the present invention to be equipped with a latch 23 shown in FIGS. 1 to 7 in the top part 4, it is necessary that the latch 23 according to the present invention is designed so that on the stamping component 2, a latching element, in particular the latch 23, is arranged with a locking clip 36 connected so as to move synchronously for fixing the top part 4 to the bottom part 6 in a defined position, wherein the locking clip 36 is arranged in the bow-shaped top part 4, as can be seen in FIG. 8.

Here, the plastic part 19 of the top part 4 comprises a guide channel 37, into which the locking clip 36 is inserted in the assembled state. The guide channel 37 is created by a U-shaped formation of the plastic part 19 of the top part 4, the latter being completely or partly closed at the lateral bars 9, 10 by a receiving element 38. The receiving element 38 comprises a cavity (not shown), into which the spring element 27 is inserted from below, so that the receiving element 38 at the same time serves as a guide for the spring element 27. Furthermore, the plastic part comprises openings 39, from which a latching hook 40 of the locking clip 36 protrudes upon activation of the latch 23 provided on the locking clip 36, i.e., when the latch 23 is not actuated, the latching hooks 40 are arranged in the plastic part 19 of the top part 4, i.e. in the guide channel 37, whereas upon actuation of the latch 23 the locking clip 36 is rotated by means of moulded pivot pins 41 and thus the latching hooks 40 are pivoted out of the openings 39 so that they can engage in the bottom part 6 in a corresponding position for fixing the stamp 1. For such a rotary motion to be possible, in the plastic part 19 of the top part 4 corresponding bearing elements for the pivot pins 41 are arranged, to which end the locking clip 36 needs only to be inserted into the guide channel 37. Subsequently, the metal part 18 of the top part 4 is fitted onto the plastic part 19 of the top part, wherein the latching in the lower part takes place at the parts at the openings 39, to which end the metal part 19 of the top part 4 is formed correspondingly in this region, i.e. the metal part 18 of the top part 4 is formed in the end region in such a manner that it comprises a latching surface 43 which latches into a corresponding recess with an undercut (not shown) in the plastic part 18 of the top part 4. Thus, the metal part 18 is pressed into the plastic part 19 of the top part 4 and latched. To prevent the metal part 18 from being pressed into the guide channel 37 in a forceful stamping operation, in the region of the guide channel 37 and in the bearing area of the metal part 18 a support groove is arranged, which can be positioned so that when the metal part 18 abuts, the plastic part 19 takes up a wall thickness of the metal part 18 and the plastic part 19 is flush with the surface 4 of the metal part 19, i.e. the plastic part 19 of the top part 4 is completely accommodated.

Of course, it is also possible that the locking clip 36 does not end in the top part 4, but exits in the lower portion of the top part 4 below from the top part 4, so that it can engage into corresponding latching steps upon actuation of the latch 23 (not shown).

Furthermore, the plastic part 19 of the top part additionally comprises a fastening connector 42 for the handle element 5, for which purpose a recess is arranged in the metal part 18 of the top part 4, through which the fastening connector 44 can be inserted. The handle element 5 is made of at least two different materials 46, 47, of which one material 46 is resilient for the purpose of absorbing compressive forces. Here, for absorption of compressive forces the elastic material 46 is arranged in the transition region to the top part 4, so that during a stamping operation with excessive force first the stamp 1 is pressed into the stamping position 19 and then the elastic material 46 is compressed. It is thus made sure that a very high excess force can be absorbed by the compression of the elastic material 46 on the handle element 5, so that the stamping components 2 are not damaged.

As shown in FIG. 8, the handle element 5 is multi-part in design, in particular bipartite, where the first part is a base body 47 formed from the two different materials 45, 46, and the second part can be plugged on as a cap 48. The cap 48 is preferably designed to differ from the remaining plastic parts 19, and preferably has a different color. Furthermore, the cap 48 has a special front face 49 which can be lettered with a laser, where due to the heat produced by the laser the surface changes in this heated part and thus the stamp can be customized or lettered, respectively. As material, preferably a plastic mixture with color change is used for this purpose. Here the laser-etching of the cap 48 can be carried out without the stamping component 2, and [the cap] is then simply plugged onto the installed base body 47 of the stamping component 2.

With appropriate shaping and use of the elastic material 45 it is also possible that the base body 47 is entirely formed of the elastic material 45, and the additional material 46 forms the cap 48. It is also possible that between the handle element 5 and the top part 4 an extra part of the elastically deformable and recoverable material 45 is attached, in particular an intermediate inlay (not shown) that is fitted onto the fastening connector 44 before plugging on the handle element 5, so that this element can then absorb excess force.

Figure 9:
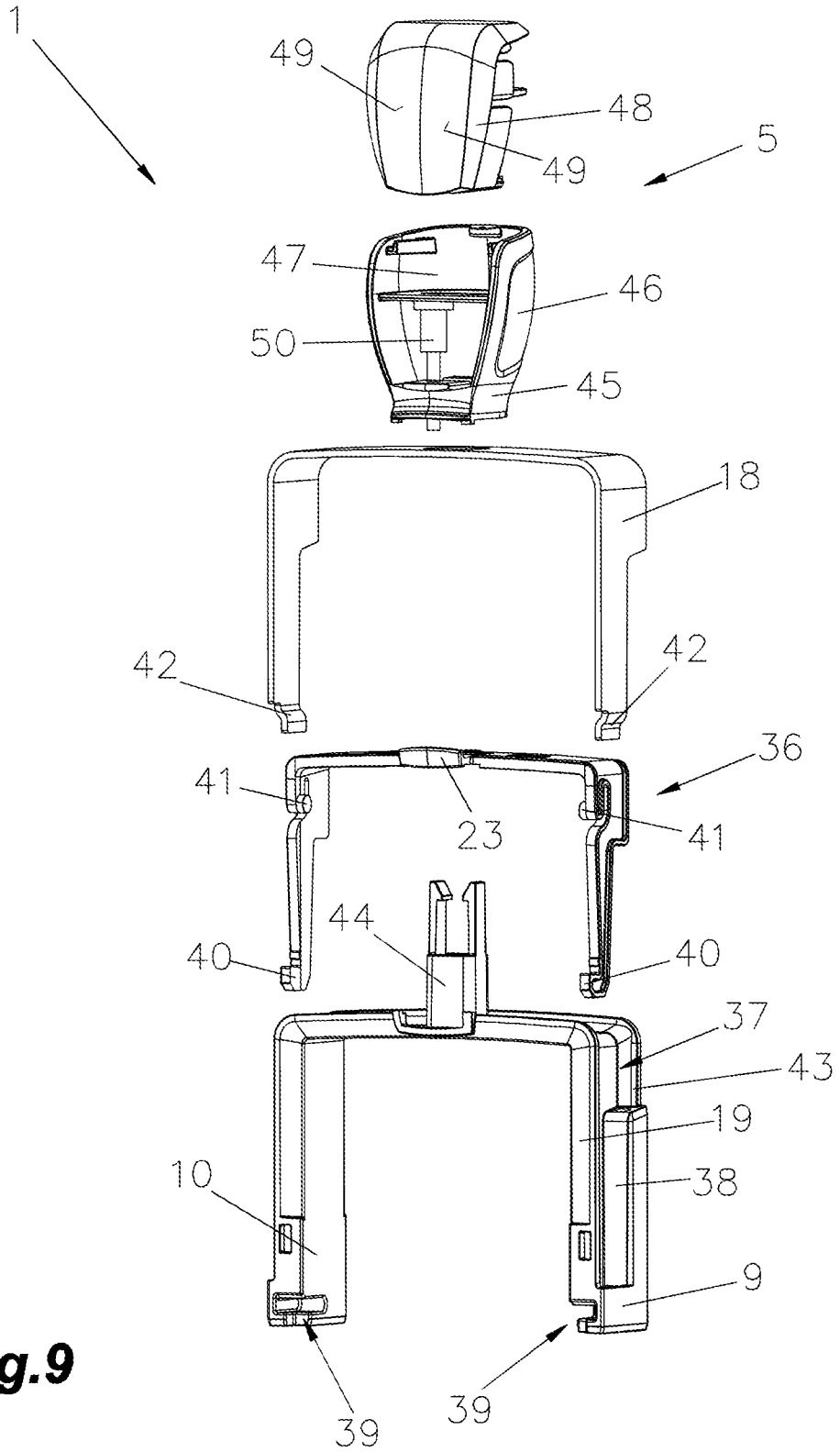
FIG. 9—another exemplary embodiment of a cushioned handle element to absorb excess force in a stamping process; simplified, for illustrative purposes only.

As shown in another embodiment according to FIG. 9, it is also possible that the handle element 5 is mounted via a damping device at the top part establishing an elastically resilient connection. The damping device may comprise a spring or a fluid-filled or gas-filled shock absorber, wherein the damping device 50 is on the one hand guided or mounted in the base body 47 of the handle element 5 and on the other hand supported by or attached to the fastening connector 44. Preferably, the lower part of the base body 47 is in turn formed with an elastic material so as not to lock the damping device upon compression of the damping device 50. Here, the elastic material 45 may be designed to be supportive to absorb force or merely serve as a cover that deforms without impact of much force. Of course it is also possible that an intermediate inlay (not shown) may be used here.

In FIGS. 10 to 14, the individual parts of the stamp 1 of the invention are shown. Here only the bottom part 6 is addressed in more detail, since the top part 4 has already been described in detail in FIGS. 8 and 9. It should be mentioned here that in order to better distinguish between the metal parts 18 and plastic parts 19, these are provided with the suffix "a", "b", where "a" refers to elements of the top part and "b" of the bottom part.

Figure 10:
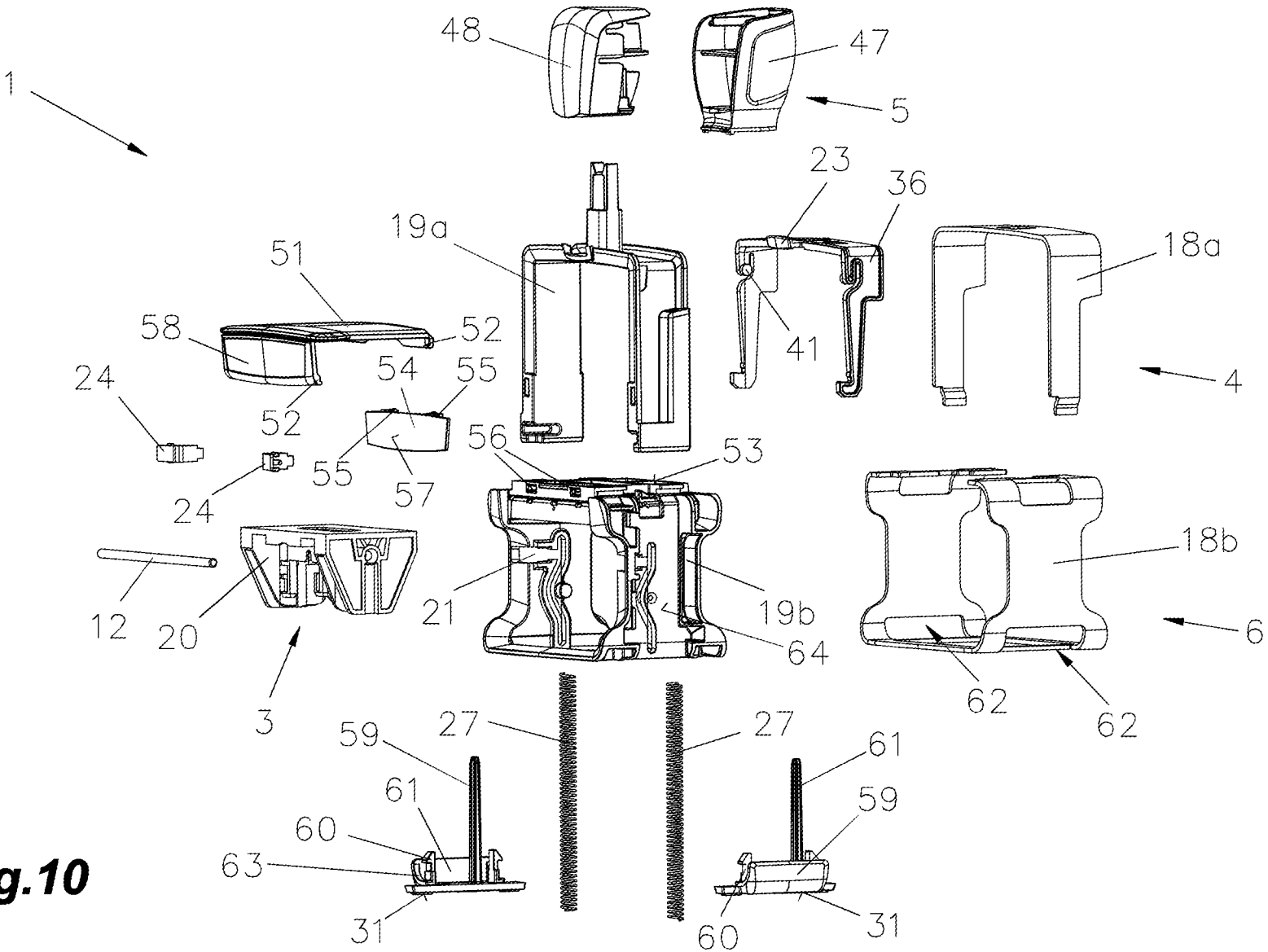
FIG. 10—schematic illustration of the metal part and the plastic part of the bottom part of the stamp according to FIGS. 1 to 9; simplified, for illustrative purposes only.

As can now be better seen in FIG. 10, in addition to the parts already known the stamp 1 furthermore comprises a preferably transparent window element 51 that can be fitted in a simple manner onto the bottom part 6, in particular the plastic part 19*b*, and is attached via latching elements, especially snap-in noses 52. The window element 51 serves to facilitate placing a specimen stamp (not shown) on a surface 53 of the plastic part 19*b*, whereupon subsequently the window element 51 is mounted, so that the user can see the specimen stamp from above. Here, it is also possible that the window element 51 is connected via a hinge joint to the bottom part 6, in particular the plastic part 19*b*, so that the window element 51 can be opened and closed.

Furthermore, the stamp 1 or the stamping component 2, respectively, comprises a customization surface 54. Here the customization surface 54 is designed to be interchangeable, in particular pluggable, and is attached, for example, via a latching connection, in particular a latching hook 55 and a latching opening 56. It is also possible that the customization surface is formed in several parts, so that, for example, an outer surface 57 is formed with a high-quality material, such as platinum, gold, silver, etc., to be inserted into a frame preferably made of plastic (not shown). This has the advantage that the frame can be easily manufactured for the latching connection and the high-quality, cost-intensive surface is made as simple as possible.

However, preferably the customization surface 54 is made of a laser-processable plastic material, such as used for the cap 48. Here the colors of the cap 48 and the customization surface 54 are preferably identical. The labelling or laser-etching with individual texts, logos, etc. is carried out independently of the stamping component 2, so that the latter subsequently only has to be clipped on.

In the stamp 1 according to the invention, the window element 51 is formed in such a manner that this extends over a partial region via a window extension 58 of the front face of the bottom part 6. It is thereby ensured that, when the customization surface 54 is inserted, the window element 51 covers the customization surface 54 and thus protects it from damage. Of course, it is possible that the window element 51 has a bipartite design, wherein one window element 51 can be fastened for the specimen stamp and the second window element 51 is used for the customization surface 54.

The preferred material for the customization surface 54 has been found to be a plastic mixture with color change, as this changes its surface color in a laser procedure and can be engraved according to the user's wishes. For example, the company logo, the name, the internet address, etc. of a stamp dealer or alternatively the company logo, a product brand, etc. of the company using the stamp(s) can be arranged.

Furthermore, it is possible that the customization surface 54 comprises a cavity (not shown), in which a chip or other identification system can be provided, so that for special use of the stamp 1 a corresponding tracking is possible.

The special subsequent customization of the stamping component 2 using the customization surface 54 and the cap 48 render cost-efficient contract manufacturing with a quantity of 1 possible, because the component 2 can be prefabricated in large numbers and subsequently the cap 48, the customization surface 54 and the stamping insert 3 can be inserted, i.e. the stamp 2 is designed for subsequent customization by installation of one or several replaceable elements, in particular a customization surface 54, a cap 48 and a stamping insert 3.

For from the state of the art it is only known that the cap 48 of the stamp 1 can be individually adjusted and replaced, while other parts or elements of the stamping component 2 can be printed or laser-etched only with great effort, namely directly during manufacture or in the assembled state of the stamp, so that a so-called contract manufacture with a quantity of 1 is possible only at high cost. For if any part is imprinted or laser-etched after manufacture, care must be taken to ensure upon assembly that the correct parts are used, resulting in a very large source of error, which is avoided by use of subsequent customization, since the parts can be installed as well as removed again in the assembled state of the stamp 1. When directly laser-etching or imprinting the stamping component 2, the drawback is that to this purpose an appropriate device and laser is required, into which the stamp 1 can be inserted.

Figure 11:
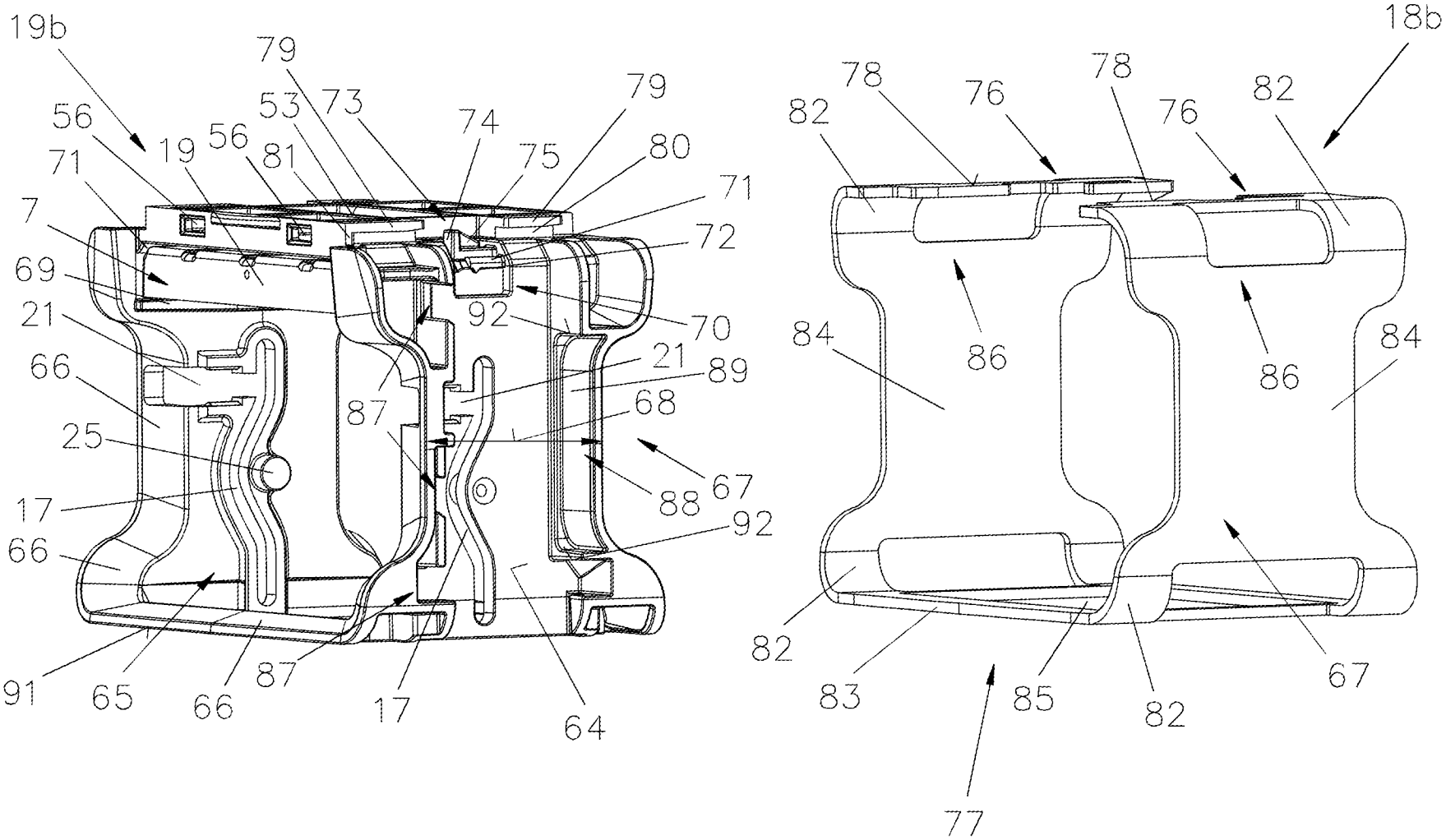
FIG. 11—enlarged view of the individual parts of the bottom part of the stamp; simplified, for illustrative purposes only.
Figure 12:
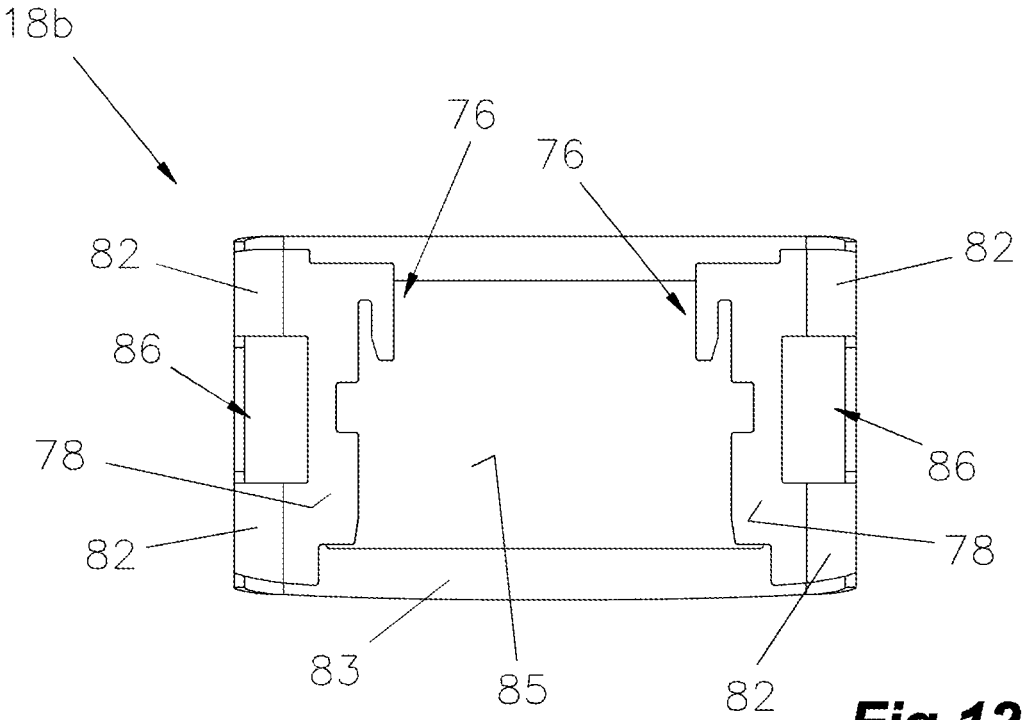
FIG. 12—plan view of the metallic bottom part; simplified, for illustrative purposes only.
Figure 13:
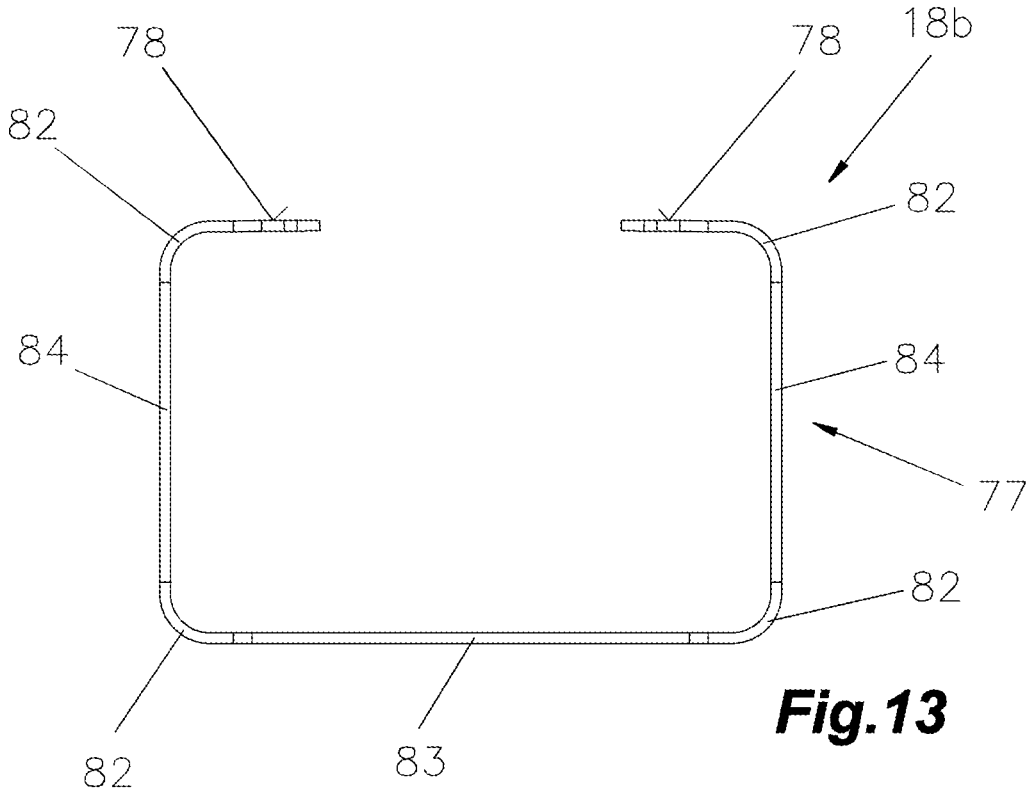
FIG. 13—lateral view of the metallic bottom part; simplified, for illustrative purposes only.

As can be seen now in FIG. 10, the stamping component 2 furthermore comprises two contact elements 59 which are concomitantly designed for centering and fixing the metal part 18*b* in the plastic part 19*b*. In this case, the contact elements 59 comprise the contact area 31 onto which the stamp 1 is placed, which, in particular the contact area 31, are designed to be slip-proof. The contact element 59 further comprises a latching element 60 for fixation in the plastic part 19*b*. Furthermore, a guide pin 61 is provided for the spring element 27. The contact element 59 is attached in such a manner to the bottom part 6 that after the positioning of the metal part 18*b* on the plastic part 19*b* the contact element 59 is inserted from below into a recess 62 in the metal part 18*b*, whereupon the latching element 60 engages in latching openings (not shown). Preferably, the contact elements 59 comprise guide grooves 63, as can be seen in FIG. 11, into which the metal element 18*b* is positioned and centered upon insertion. At the same time, the guide pin 61 protrudes into a receiving channel 64 of the plastic part 19*b*.

The plastics part 19*b* of the bottom part 6 further comprises an angular surface 66 extending into an interior space 65, which surface has a polished finish. In order to achieve good handling of a mounted band unit 19 provided on the stamping insert 3, a central part 67 has a tapered design, i.e., the central region 67 has a smaller width 68 than the upper or lower area. This taper namely allows the user to easily encompass the bottom part 6, in particular the plastic part 19*b* and metal part 18*b*, with the thumb and forefinger and make an adjustment on adjustment wheels of the mounted band unit 19.

In FIG. 11 it can furthermore be seen that the cushion-receiving element 7 is formed to be open downwards, i.e. in the direction of the interior space 65 of the plastic part 19*b*, where for the guidance of the ink pad 16 only a guide bar is arranged 69 on both sides. On the opposite side, the fastening system for an ink pad patented by the Applicant, according to patents EP 2384283 B1 and EP 2591921 B1, is arranged, so this is not going to be discussed in more detail here. Here, in FIG. 11 of the plastic part 19*b* an angular surface 71 can be seen through an opening 70 with the means 72 for fixing the ink pads 16 arranged thereon. The angular surface 71 is not designed to be continuous, but interrupted, as can be seen. The reason for this is that upon insertion or removal of the ink pad 19, the angular surface 72 can be pressed into the opening 70, which has proven to be an advantageous further development.

Due to the special design of the metal part 18*b*, a fastening element 73 is provided on the surface 53 within the lateral surface. The fastening element 73 corresponds to a looming pin 74 with a ramp 75. The pin 74 and the ramp 75 are deformable and can be pressed down into the interior space 65. During the assembly of the metal part 18*b*, due to the ramp 75 the metal element 18*b* presses the pin 74 towards the interior space 65, wherein upon reaching the correct position of the metal part 18*b* the pin 74 snaps upwards and fixes the metal part 18*b*, which means that the metallic elements can be inserted from the outside into the plastic top and bottom parts 4, 6, and these are fixed by the fastening system on the top and bottom parts 4, 6.

To this end, a corresponding fastening element is provided on the metal part 18*b*. As can be seen, the metallic part 18*b* is no longer U-shaped, as known from the prior art, but rather the metal part 18*b* has an O-shape according to the present invention 77, where an upper surface 78 of the O-shape 77 is interrupted, i.e. in particular in the upper region, i.e. on the upper surface 78, the ends of the metal element 18*b* face each other and are attached to the upper side 53 of the plastic part 19*b*.

As a matter of principle, it is possible that the metal part 18*b* is completely closed to form an O-shape 77, and corresponding recesses (not shown) are provided to receive the top part 4, in particular the surface 53 of the plastic part 19*b*, wherein the plastics part 19*b* is inserted laterally. However, care must be taken to ensure that no parts of the plastic part 19*b* protrude from the metal part 19*b* other than the movable fastening system 76.

In the illustrated embodiment, however, the surface 53 of the plastic part 19*b* is reinforced and projects beyond the metal part 18*b*, so that the O-shape 77 is interrupted on the upper surface 78 for ease of assembly. At the same time, the fastening system 73 with the pins 74 and ramp 75 is arranged in the end region of the upper surface 78, where additionally a guide bar 79 is provided, so that the metal part 19*b* can be inserted below and is thus protected against lifting off. Simultaneously, the resulting channel for the metal part 19*b* is closed by a bar 81, so assembly, in particular the fitting of the metal piece 18*b* onto the plastic part 19*b*, is possible only in one direction. This design has the advantage that the fastening system 73 can have a simple design, because the assembly always takes place from one direction only.

As shown in FIG. 11, the metal part 18*b* also comprises the taper 67, so that the handling is given with regard to an adjustment of an adjusting wheel of the mounted band unit 19. As previously mentioned, in the lower region, which merges at a radius 82 from an underside 83 into the vertical lateral surfaces 84, whereupon the metal part 18*b* in turn extends from the lateral faces 84 at the same or a different radius 82 to the upper surface 78. On the underside 83, a large recess 85 for forming a stamp impression is arranged via the stamping insert 3, i.e., in the assembled state, the stamping insert 3 protrudes through the recess 85 when in the stamping position 14.

Furthermore, in the transition region from the underside 83 to the lateral surfaces 84 the recesses 62 for the contact element 59 are provided, so that the same can be inserted and fixed.

In order to connect now the top part 4 to the bottom part 6, in the transition region between the lateral surfaces 84 and the upper surface 78 receiving openings 86 are provided, through which the bow-shaped top part 4 can be introduced through the metal part 18*b* into the receiving channel 64, and be positioned therein. The receiving channel 64 is designed such that on the one hand the bow-shaped top part 4 is arranged and on the other it receives the spring element 27 for automatic resetting into the resting position 13. Concomitantly, in the receiving channel 64 for the latching via the barrier 23 at the corresponding positions latching recesses 87 are provided, into which the latching hook 40 engages. Here, in the stamp according to the invention 1 three recesses 87 and thus three latching positions are possible, in which the stamp 1 can be fixed.

The assembly of the stamp 1, in particular the stamping component 2, is done e.g. in such a manner that first the top part 3 is assembled, for which purpose the locking clip 36 with the latch 23, in particular the locking button, is inserted into the plastic part 19*a*, whereupon the metal part 18*b* is pushed up and latches accordingly. Subsequently, the base body 47 of the handle element 5 is placed on the fastening connector 44, so the top part 4 with mounted handle element 5 is completely assembled. For the bottom part 6, the metal element 18*b* is pushed over the plastic part 19*b*, so that the metal part 18*b* latches on the surface 53 of the plastic part 19*b*. Subsequently, the two contact elements 59 are pushed from below into the recesses 62 and centre and fix the metal element 18*b* additionally in the plastic part 19*b*, where the guide pin 61 extends into the receiving channel 64 closed by the metal part 18*b*. The spring element 27 is now inserted from above through the receiving opening 86 into the receiving channel 64 and plugged onto the guide pin 61. Finally, only the top part 4 remains to be inserted through the receiving recess 86, whereby the spring element 27 is received in the receiving element 38.

To prevent the top part 4 from being simply pulled out of the receiving channel 64, here a guide system 88 is provided that consists of a guide track 89 in the receiving channel 64 and a guiding burl (not visible) on the top part 4, in particular the plastic part 19*a*, where the guiding burl is preferably designed to be elastically resilient so it will deform or give way upon insertion. When joining the top part 4 with the bottom part 6, the top part 4 is pressed with some force in the direction of a contact area 91, so that the guiding burl latches into the guide track 89, in which subsequently the top part 4 can move, wherein the guide track 89 is limited by two end stops 92. This ensures that the top part 4 cannot be pulled out of the guide channel 64 easily.

Of course it is also possible that the stamp 1 is equipped without the guide system 88, so that the top part 4 is simply inserted into the receiving channel 64. The top part 4 can then be fixed by pressing the latch 23 until a stamping insert 3 is inserted. In such a system for replacement of the stamping insert 3 it is necessary that the top part 4 is decoupled from the stamping insert 3, for which purpose a corresponding receiving channel 90 for the shaft 12 or trunnion 12 is provided in the top part 4, i.e. in the interchange position 22 the exchange channel 21 in the bottom part 6 and the receiving channel 90 in the top part 4 are arranged at the same level, so that the shaft 12 can be inserted and is arranged in the receiving channel 90 for fixing the top part 4 to the bottom part 6. If the exchange channel 21 is closed, the top part 4 is coupled to the bottom part 6 via the stamping insert 3.

By mounting the top part 4 onto the bottom part 6, the assembly of the stamping component 2 is completed. Subsequently, the stamping component 2 can be customized according to the customer's wishes, in that a cap selected by the customer 48, a correspondingly selected customization surface 54 and the desired stamping insert 3 are inserted, so that the stamp 1 is assembled. Thus, it is now possible that the stamping component 2, the stamping insert 3, the cap 48 (without lettering or laser-etching) and a customization surface 54 can be produced in large numbers, but then assembled for customization. In particular, the cap 48 and the customization surface 54 can be simply imprinted or laser-etched and inserted subsequently, enabling processing of orders in quantity 1.

In FIGS. 14 to 17, the design of the ink pad 16 is shown and described, where, as mentioned above, the Applicant's attachment system according to the invention is used. Here, the ink pad 16 comprises at least one support device 93 for receiving a cushion 94 (e.g., ink-impregnated), where the support device 93, especially the side that is associated with a stamping insert 3 in the stamp 1, is designed to be open on one side, and the support device 93 comprises on a longitudinal side 95 a handle element 96 for positioning in the stamp 1 or removal from the stamp 1. As can furthermore be seen, via a partial region of the narrow sides 97 an angular surface 98 with means 99 attached to it are provided for fastening to the stamp 1.

Figure 14:
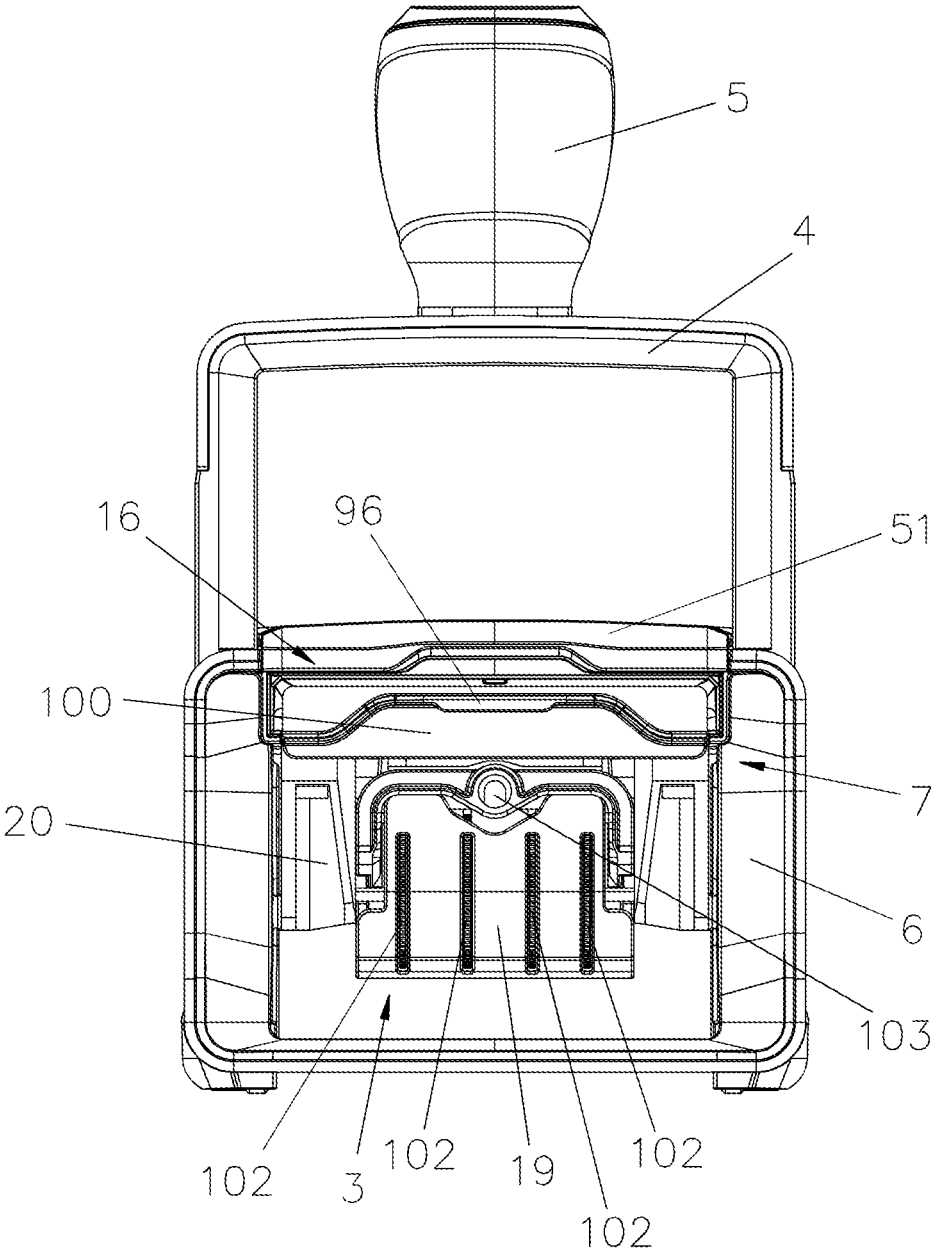
FIG. 14—view of the stamp from the rear with ink pad inserted and a stamping insert having a mounted band unit arranged therein; simplified, for illustrative purposes only.
Figure 15:
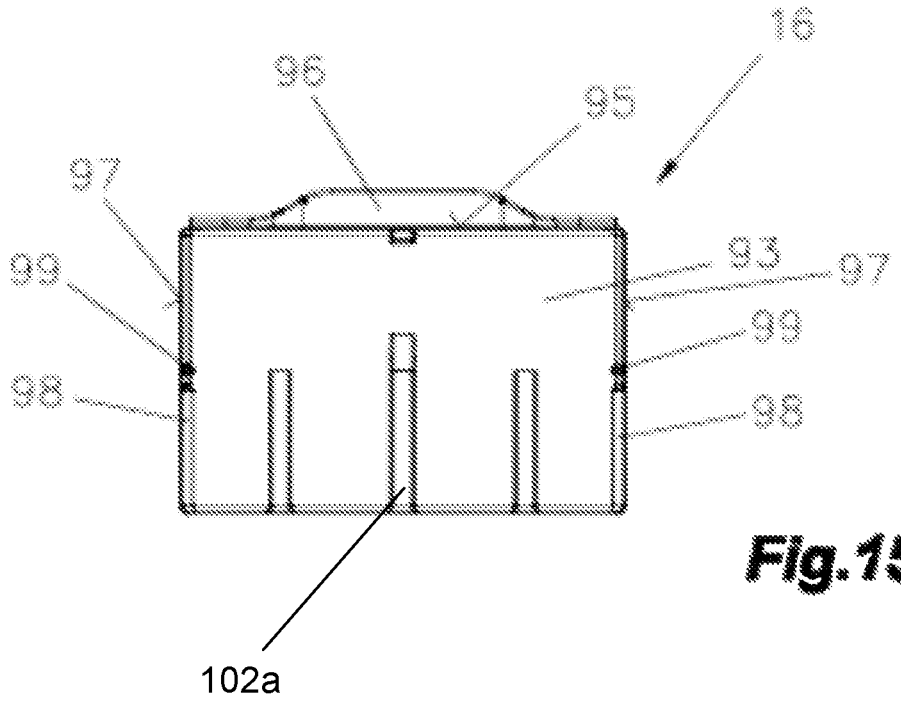
FIG. 15—plan view of the ink pad; simplified, for illustrative purposes only.
Figure 16:
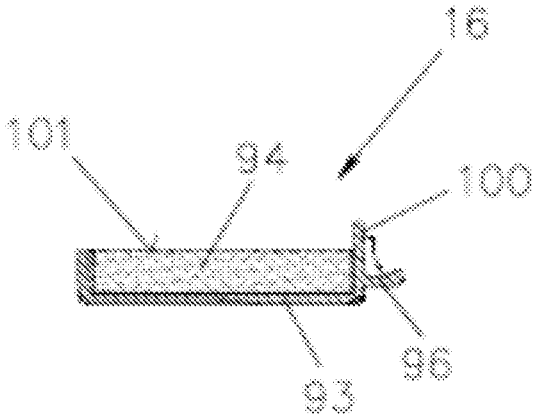
FIG. 16—sectional view of the ink pad; simplified, for illustrative purposes only.
Figure 17:
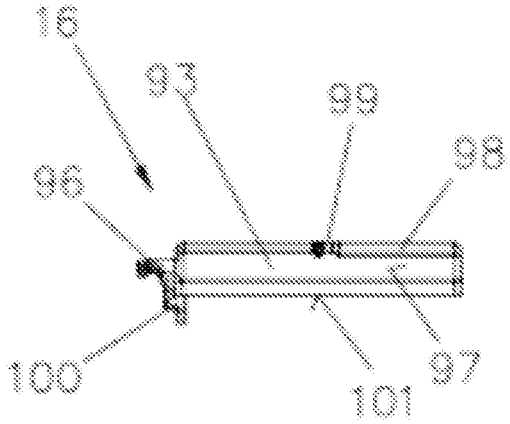
FIG. 17—lateral view of the ink pad; simplified, for illustrative purposes only.

According to the present invention it is now provided that on that longitudinal side 95 on which the handle element 96 is provided, a protective cover 100 is provided which extends over an upper edge 101 of the open support device 93. The protective cover 100 here corresponds to an extension of the longitudinal side 95. This ensures that when the ink pad 16 is inserted, as shown in FIG. 14, the protective cover 100 extends toward the interior space 64 of the bottom part 4, so that access to the cushion 94 is hampered and thus the protective cover 100 guards protects against soiling with ink. In particular, this is of special advantage when the stamp 1 is compressed and the user wants to make adjustments in the interior space 65 using the adjusting wheels 102 of the mounted band unit 19, as the user's finger, especially the back of the finger, cannot reach the cushion 94 anymore. In FIG. 14, the mounted band unit 19 is designed as a date with central adjustment 103, so four adjustment wheels 102 are present, where the stamp 1 is shown in the resting position 13, in which the mounted band unit 19 and the text plate 15 (not visible) abut against the cushion 94 of the ink pad 16 for ink uptake.

On the opposite side of the stamp 1, the protection is provided e.g. by the customization surface 54. Preferably, the customization surface 54 and the protective cover 100 protrude equally far towards the contact area 91. Another advantage of the protective cover 100 lies in the fact that when pulling out or inserting and while holding the ink pad 16, the user's finger can no longer slip into the cushion 94, as the protective cover 100 extends sufficiently far over the upper edge 101.

Furthermore, on the outside of the support device 93 the ink pad 16 comprises one or several guide and/or stop grooves 102*a*, so that when inserting the ink pad 16 into the cushion-receiving element 7 the ink pad 16 is on the one hand guided and/or on the other limited, meaning that in the stamp 1 matching corresponding projections are arranged (not shown), so that upon insertion of the ink pad 16 these projections act as stops, and the ink pad 16 cannot be pushed too far into the cushion-receiving element 7. Thus via the guide and/or stop grooves 102*a* and the projections a positioning of the ink pad 16 is formed. It is also possible to arrange the means conversely, i.e. to arrange the guide and/or stop grooves in the stamp, and the projections on the ink pad 16.

Figure 18:
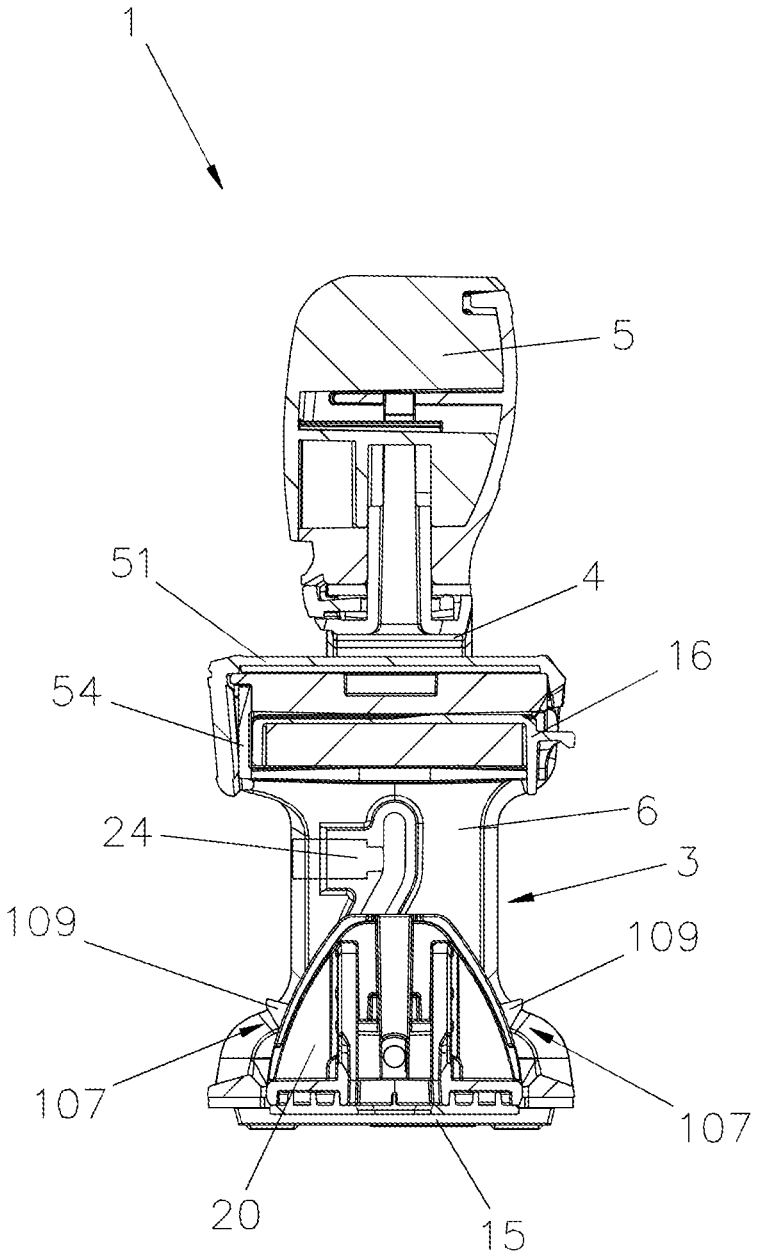
FIG. 18—sectional view of the stamp with stamping insert inserted and without closure cap in the stamping position; simplified, for illustrative purposes only.
Figure 19:
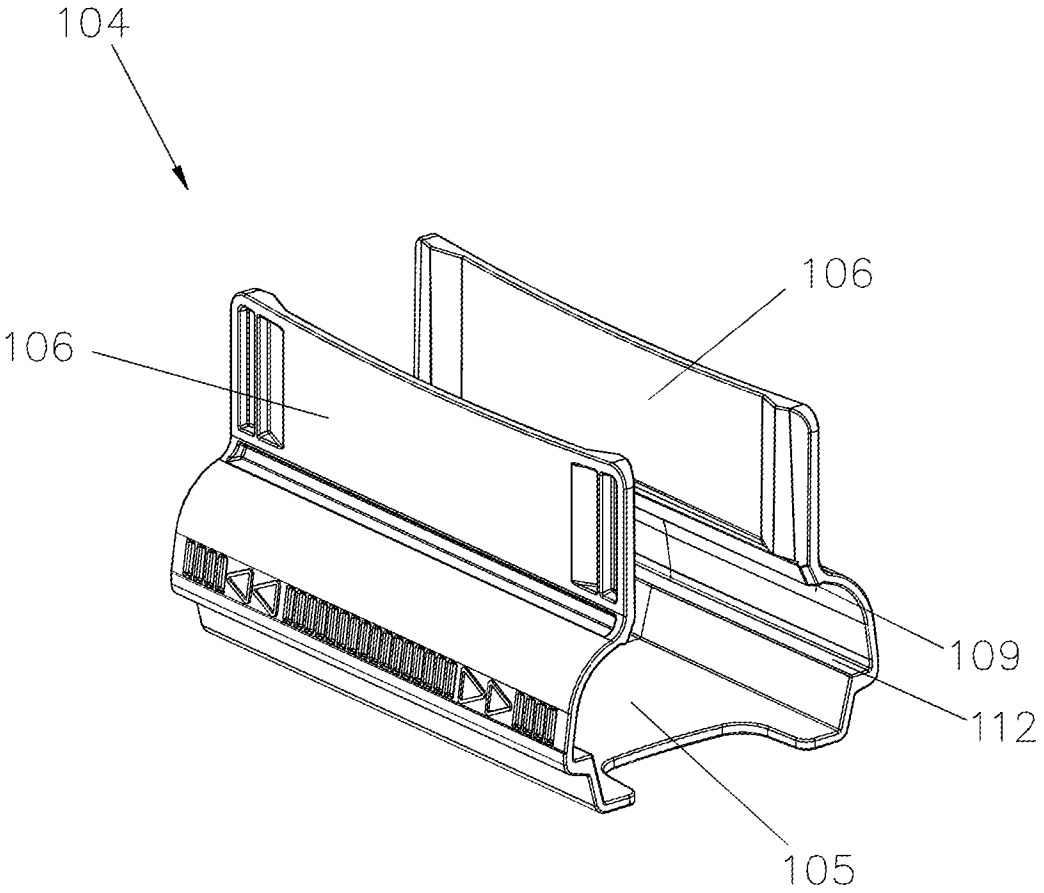
FIG. 19—schematic illustration of the closure cap; simplified, for illustrative purposes only.
Figure 20:
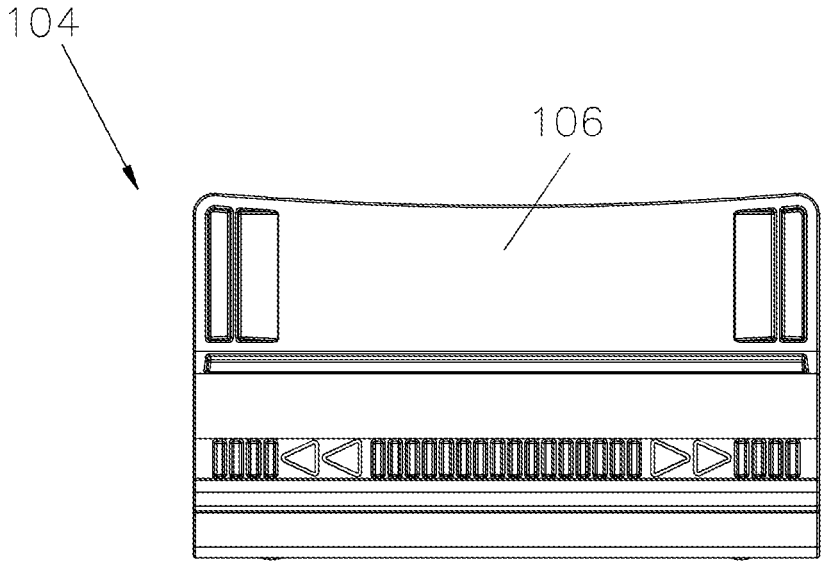
FIG. 20—lateral view of the closure cap; simplified, for illustrative purposes only.
Figure 21:
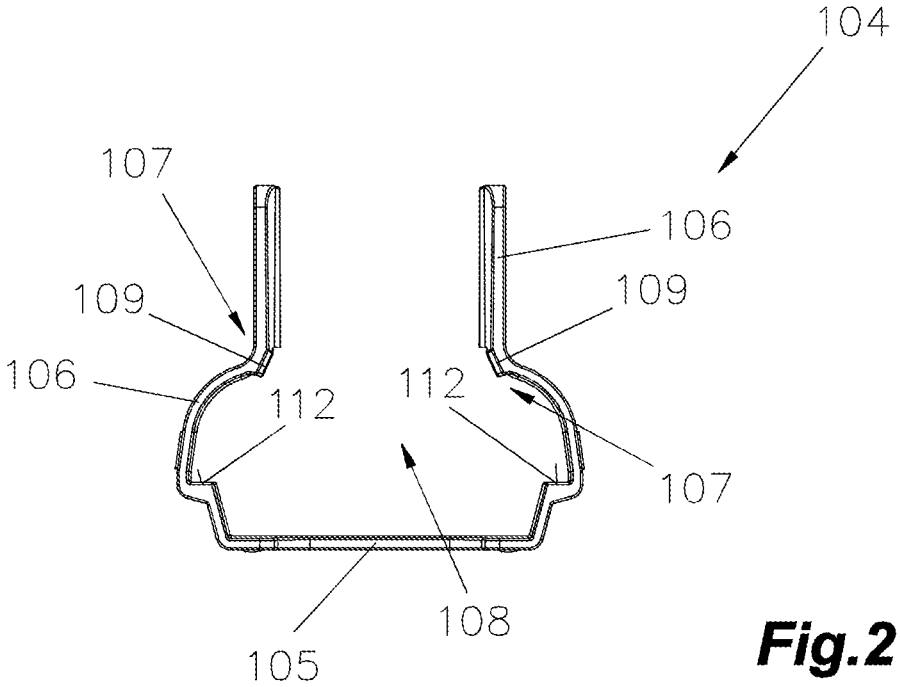
FIG. 21—sectional view of the closure cap; simplified, for illustrative purposes only.
Figure 23:
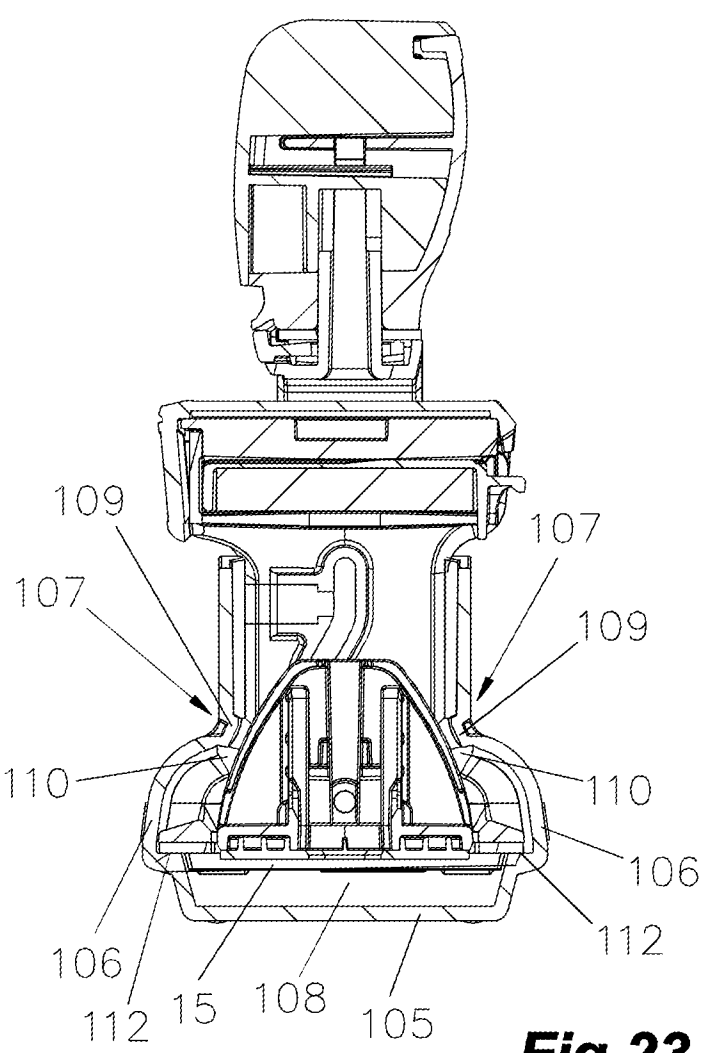
FIG. 23—sectional view of the stamp with the closure cap fitted; simplified, for illustrative purposes only.
Figure 22:
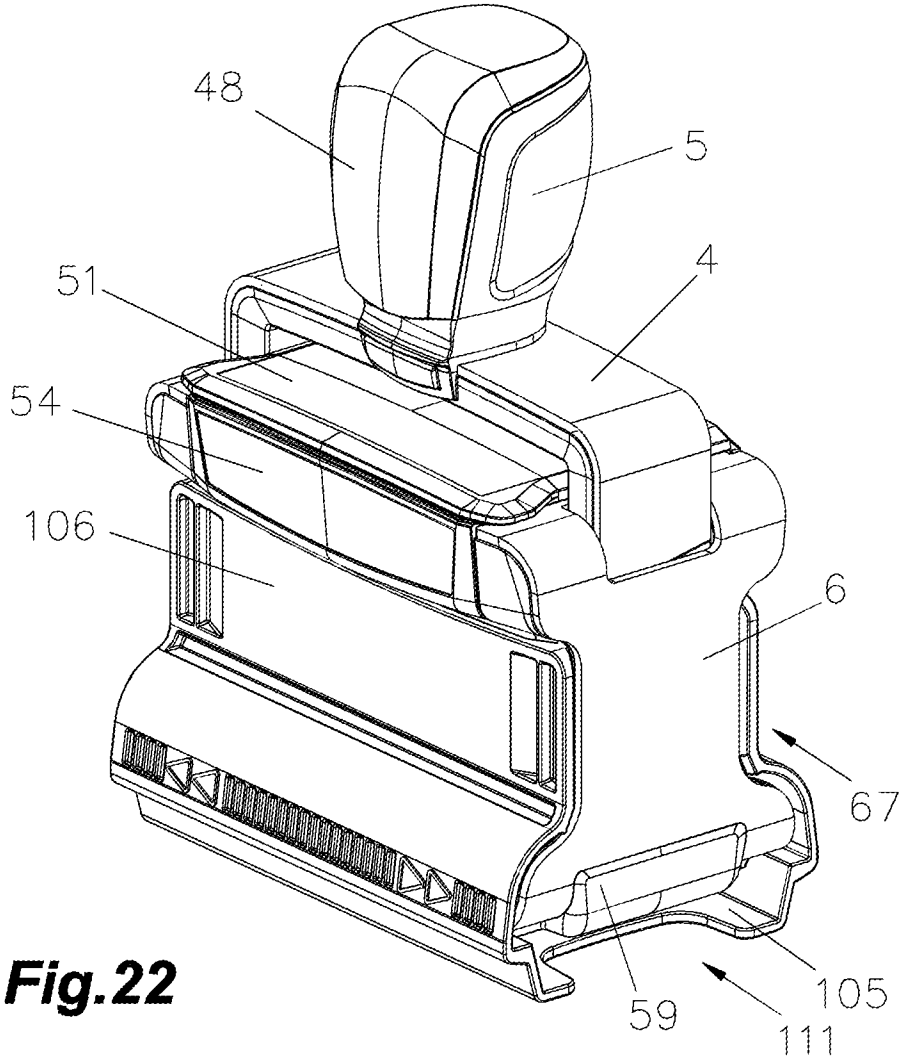
FIG. 22—schematic illustration of the stamp 1 with closure cap fitted; simplified, for illustrative purposes only.

FIGS. 18 to 23 show and describe an embodiment of the stamp 1, in particular a self-inking stamp 1, for the first time with a closure cap 104, where in FIG. 18 the stamp 1 is shown in cross-section and without the closure cap 104, but, in the position with closure cap 104.

The closure cap 104 includes at least one plate-shaped bonnet 105 having protruding side walls 106, where the bonnet 105 can be fitted onto the bottom of the bottom part 6 of the stamp 1, and the side walls are formed for fixing to the stamp 1, i.e. the closure cap 104 is not plugged onto the stamp, as known from the prior art, but the closure cap 104 is slid on. To this end, the stamp 1 is first brought into the stamping position 14, then subsequently the closure cap 104 is pushed laterally onto the bottom part 6, so that the bonnet 105 protects the text plate 15 and the side walls 106 cover the interior space 65 of the bottom part 6, while at the same time without actuation of the latch 23 the stamp 1 is held in this position, in particular the stamping position 14, by the closure cap 104.

Covering of the interior space 65 has the advantage that thereby no dirt can reach the exposed cushion 94. At the same time it is also avoided that a user can reach into the interior space 65. Of course, it is also possible that the side walls 106 loom only slightly laterally at the bottom part 6 to enable the sliding on of the closure cap 104.

For such a solution according to the present invention of the closure cap 104 to be possible, to this end an appropriate retention system 107 is provided. The retention system 107 comprises a support surface 109 or notch, respectively, in the interior area 108 of the closure cap 104, whereas retention elements 110 are provided on the text plate carrier 20 of the stamping insert 3. The closure cap 104 preferably has the shape of the bottom part 6 with the tapering in the central region 67. To facilitate the handling for the removal of the closure cap 104, recesses 111 are provided on the bonnet 105, which are formed such that they match the contact element 59, so when reaching into the recesses the user is not soiled. Thus, when the closure cap 104 is pushed up it is possible that in order to remove the closure cap 104 the user inverts the stamp 1 and reaches with the thumb and forefinger of one hand into the recess 111 and next simply and safely pulls out the closure cap 104 easily and safely sidewards. Here it is also possible that the recess 111 comprises a bottom surface (not shown) integrally molded via side walls to the bonnet 105, so that the when reaching into the recess 111 the user can no longer come into contact with the text plate 15. As can be seen better from FIG. 23, the closure cap 104 may also have a support surface 112 onto which the bottom part 6 can be placed.

Of course, it is also possible that the fastening of the closure cap 104 can be structured conversely, for which purpose e.g. the retention element 110 can be arranged on the closure cap 104 and on the text late carrier 20 support surface 109 are provided, into which the retention elements 110 engage when the closure cap 104 is pushed on. Thus, secure fastening of the closure cap 104 to the stamp 1 is guaranteed. Moreover, it is possible that the closure cap 104 can be pushed on even without stamping insert 3, whereby due to the shape the stamping component 2 is held in the stamping position or in a closed position, respectively. It is also possible that the support surface 109 or the support element 110 is provided on the stamping component 2.

For optimal alignment of the text plate 15 to be made, it is possible that the double-sided adhesive tape 34 is provided with a grid 113 (shown schematically), so after the application of the double-sided adhesive tape 34 onto the text plate mounting surface 33, the text plate 15 can be easily positioned and glued in accordance with the grid 113. During use with a double-sided adhesive tape 34, it was found that the positioning of the purchased double-sided adhesive tape 34 provided with the grid 113 is very laborious, since it must be precisely aligned.

Another solution, as described in WO 2014/172738 A1 which is incorporated fully herein, has the disadvantage that only special transparent double-adhesive tapes 34 can be used, so through the transparent double-sided adhesive tape 34 the grid 113 of the laser-etched text plate mounting surface 33 can be seen. A further disadvantage is that after application of a double-sided adhesive tape 34 very thin lines are no longer visible.

According to the present invention now the double-sided adhesive tape 34, in particular a so-called self-punching part for attaching the text plate 15, is applied with the two layers of adhesive 114 and a transparent or non-transparent support medium 115, as shown in FIG. 7, onto the text plate mounting surface 33, and subsequently using a laser device (not shown) the grid 113 is generated by laser-etching of the support medium 115. Thereby it is made possible in an advantageous manner that any double-sided adhesive tape 34 can be used with or without a transparent support medium 115, wherein the bonding onto the text plate mounting surface 33 is performed without alignment, and subsequently the grid 113 is aligned in accordance with the text plate mounting surface 33.

When using a stamping insert 3 according to the present invention, the double-sided adhesive tape 34 is bonded directly onto the text plate mounting surface 33, whereupon the entire stamping insert 3 is inserted into a receiving element of a laser apparatus and the grid 113 aligned accordingly. It is also possible that markings (not shown) may be arranged in addition to the grid 113.

Alternatively, it is also possible that before the bonding of the double-sided adhesive tape 34, the grid 113 is applied by laser directly on the double-sided adhesive tape 34, and subsequently the double-sided adhesive tape 34 is bonded on. This has the advantage that a double-sided adhesive tape 34 with a non-transparent support medium 115 is used, and any desired grid 113 and any label can be applied, unlike the situation when a double-sided adhesive tape 34 already provided with grid 113 is used. For an optimal laser treatment to be carried out, it is possible that the double-sided adhesive tape 34 is first bonded to a carrier material (not shown), followed by the laser-etching of the support medium 115, after which the double-sided adhesive tape 34 is peeled off and glued onto the text-plate mounting surface 33.

A further advantage of such laser-etching of a self-punching part and double-sided adhesive tape 34 is that the text plate mounting surface 33 is not damaged or soiled, so that reliable fastening is ensured. When laser-etching directly on the surface, the heat effect may lead to irregularities, whereby it is no longer ensured that the double-sided adhesive tape 34 rests on the entire surface. It is also possible that instead of a grid 113 other shapes can be used for the positioning and centering of the text plate 15. Preferably, here rectangles are used up that correspond to the standardized text plate sizes. For this purpose, the size specifications can be applied onto the support medium 115 as well, so that easy orientation is achieved.

A part according to the present invention of the figures described above here corresponds to the stamping insert 3 for a stamp 1 as described, wherein the stamping insert 3 comprises a text plate carrier 20 for receiving a text plate 15 and/or a mounted band unit 19, where the text plate carrier 20 comprises a receiving guide 26 for receiving a guide pin 25 of the stamp 1 and a preferably insertable or fixed shaft 12 or trunnion or swivel pin 12, respectively, for forming a rotary motion in the stamp 1, and said stamping insert 3 as such can be designed to be insertable and/or interchangeable for a stamping component 2 of the stamp 1. Here, the text plate carrier 20 can be equipped with various components, particularly for date or IBAN, with chip, RFID, stamping counter, etc., for which corresponding retention elements and/or receptacles are arranged on text plate carrier 20. Here only an embodiment for a mounted band unit 19 as a date or a text-only plate is described and shown, i.e. various designs of the stamping insert 3 are possible that can be inserted into the stamping component 2, for which purpose even an electronic design of the stamping insert 3 is possible. Namely, if no continuous shaft 12 is used, but only trunnions or swivel pins are, the text plate carrier 20 can have a U-shaped design, wherein the space between the two outer legs can be of arbitrary shape. As described previously in detail, the stamping insert 3 is designed for insertion or removal via the exchange channel 21 of the stamping component 2.

Preference is given to the text plate carrier 20, in particular a text plate mounting surface, with a so-called TPO attachment (Text Only Plate fixing) designed for the text plate. For example, at the stamping insert 3 the text plate 15 can be attached to a support plate, where the support plate is positioned via a frictionally fitting fastening system on the stamping insert, especially on the text plate carrier, where preferably on the support plate several elevations are provided that engage in corresponding recesses or receptacles, and the connection is established via the friction of the surfaces between the elevations and the receptacles.

In the structure 1 described above, substantially a stamp 1 is formed from two different materials, particularly the metal parts 18, 18*a*, 18*b* and the plastic parts 19, 19*a* and 19*b*. Here, the metal parts 18, 18*a*, 18*b* are made from brushed or chromed or polished steel, while the plastic parts 19, 19*a* and 19*b*, especially the top part 4 and the bottom part 6, are made of recycled plastic, ABS, POM or the like. In particular, as a grip material a polymer of polyamide type and for the lateral parts a polymer of acrylonitrile butadiene styrene type is used, where for the shock absorber a simple or dosable cylinder filled with liquid or gaseous medium can be used.

Figure 24:
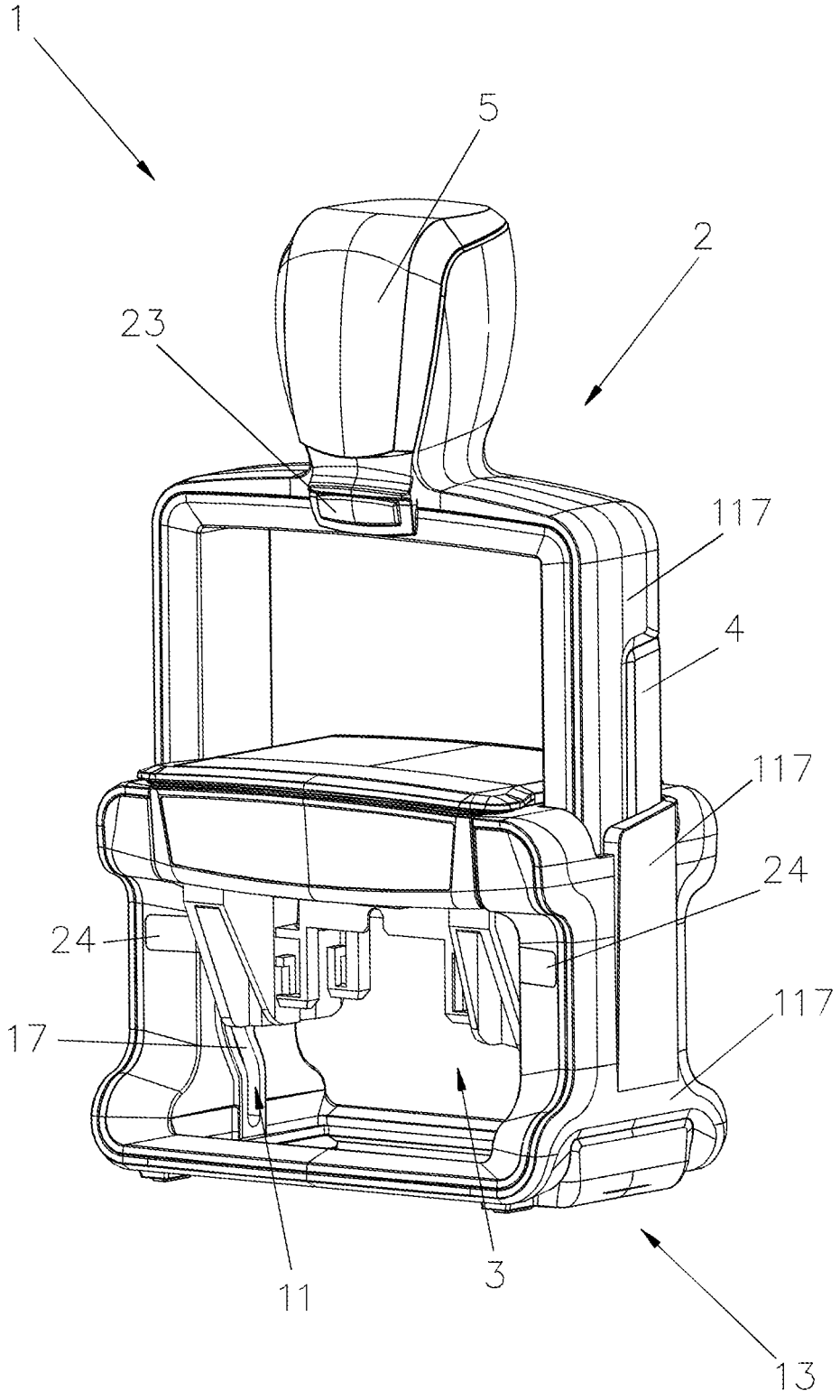
FIG. 24—schematic illustration of the stamp, in which the metal parts have been replaced with plastic components; simplified, for illustrative purposes only.

Due to the design, however, it is also possible that the metal parts 18, 18*a*, 18*b* are replaced by an alternative plastic part 117, as shown in FIG. 24. Preferably, the replacement plastic parts 117 are produced with a color different from that of the plastic parts 19, 19*a* and 19*b* of the top parts 4 and bottom parts 6, to achieve in turn a suitable design. Thereby, the manufacturing cost can be significantly reduced, so that a so-called low-cost assortment can be manufactured that, however, has all the options of the stamp 1 made of metal and plastic.

Figure 25:
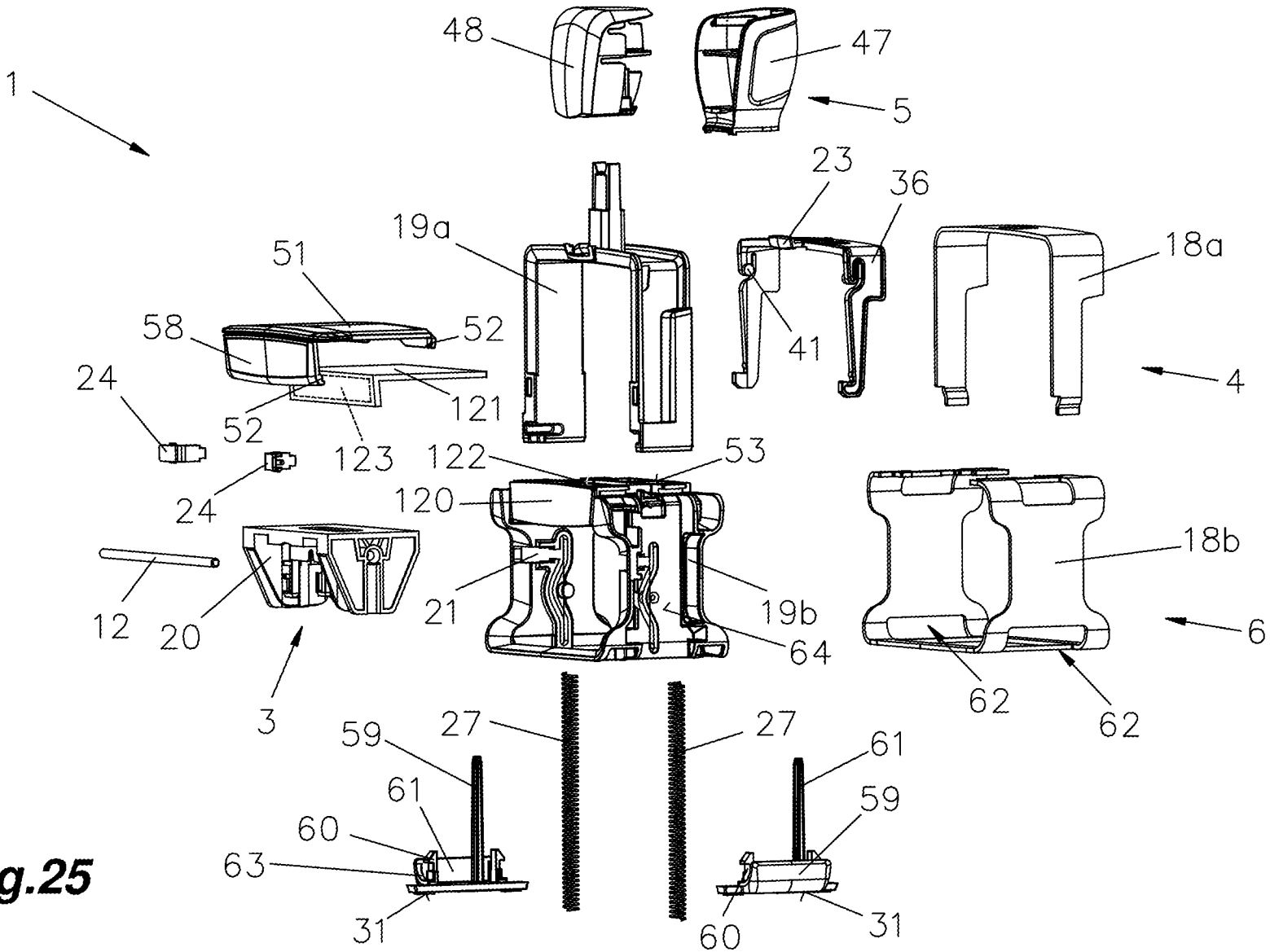
FIG. 25—exploded view of the stamp, especially the top part with a cardboard insert for the window element; simplified, for illustrative purposes only.

FIG. 25 describes a further embodiment, in which now no removable and replaceable customization surface 54 is used anymore, but an illustrated lateral area 120 is preferably formed in one piece by the plastic part 19*b* of the bottom part 6. The window element 51 is formed such that this extends from the surface of the bottom part 6 at least over a partial area of the lateral area 120 of the bottom part 6, where between the window element 51 and the bottom part 6 a free space is provided, into which a cardboard insert 121 can be inserted. Preferably, the window element 51 is supported in the border area by the bottom part 6, wherein the free space for the cardboard insert 121 is formed in between, i.e. between the bottom part 6 and the window element 51.

To achieve customization of the stamp 1, the cardboard insert 121 extends from the upside 122 to the lateral area 120, where that area on the lateral area 120 is arranged e.g. by a marking area 123 that can be accordingly adapted to the remaining customization elements, in particular the handle element 5. It is also possible that both the top part on the upside 122 of the cardboard insert and the area on the lateral area 120 can be imprinted. Preferably, on the area of the lateral area 120, especially in the marking area 123, a corporate logo of the customer can be imprinted.

It is also possible that the window element 51 comprises two separate clearances or insert areas, in particular a clearance or insert area for the upside 122 and a clearance or insert area for the lateral area 120. The cardboard insert 121 is then also bipartite and is inserted once into the upper clearance or insert area for the upside 122 and once into the lateral clearance or insert area for the lateral area 120. Here it is possible, as a matter of principle, that one or both of the areas at the window element 51 are provided with guide slots (not shown) or the like for inserting the cardboard inserts 121, so that the cardboard insert 121 is simply slid in. Preferably it has been found that the positioning in the area of the lateral area 120 with such guide slots is advantageous, since thereby the cardboard insert 121 is laterally inserted, and thus the cardboard insert 121 cannot fall out during attaching or detaching of the window element 51.

Figure 27:
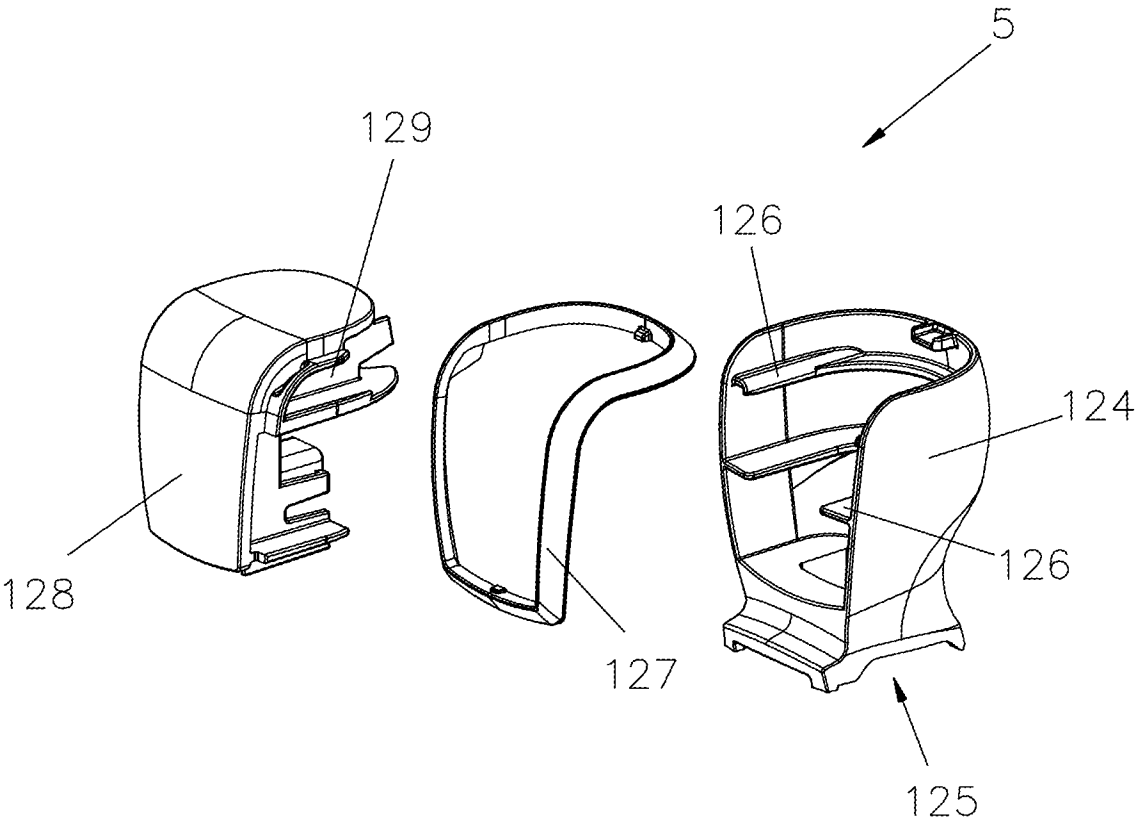
FIG. 27—exploded view of the handle element of FIG. 26.
Figure 26:
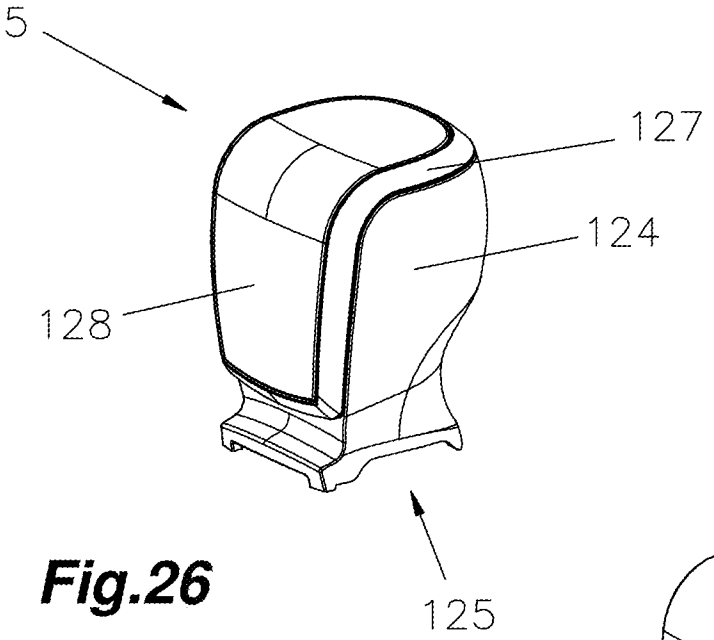
FIG. 26—schematic illustration of the tripartite handle element in the assembled state.

Furthermore, FIGS. 26 and 27 show a variant embodiment in which a new handle element 5 is used on the stamp 1. The difference from the handle element 5 described in FIG. 8 is that now the handle element 5 consists of three different parts in order to achieve a greater variety of possible variations in the color design.

Here, the first part is formed as a base body 124, on which a fastening means 125 for fastening on the stamp 1 is provided. Here the attachment can be effected by simple plugging and/or latching on the bow-shaped top part 4, or alternatively a screw connection can be established by the bow-shaped top part 4 in the base body 124. Furthermore, the base body 124 comprises one or several stiffening elements 126 in the interior, which can be used simultaneously for the fastening of a further individual part.

In contrast to the embodiment of FIG. 8, now the second individual part, namely a so-called frame element 127, is attached to or inserted on the base body 124, which is mounted on a cap 128, i.e. the frame element 127 is simply positioned on the main body 124 and fixed by fitting the cap 128 onto the base body 124. For this purpose, appropriate means of stiffening and fastening 129 are arranged on the cap 128, so that the cap 128 is fastened and/or secured, together with the frame element 127, on the base simply by plugging.

In the embodiment shown, the base body 124, i.e. the lower part of the handle, is placed from above onto the bow-shaped top part 4 and thus centered on the top part 4 via the preferably centrally provided mandrel, where in this embodiment no latching on the mandrel takes place. Subsequently, the cap 128, i.e. the upper part of the handle, is pushed from the front into the lower part of the handle and provides the latching on the mandrel of the top part 4, thus clamping and fixing the base body 124. However, before the upper part of the handle, i.e. the cap 128, is attached, the frame element 127, which is designed as a decorative part, is latched to the upper part of the handle, i.e. the cap 128.

Of course it is also possible that the individual parts, in particular the frame element 127 and the cap 128, are independently attached to the main body 124 or the individual element arranged before it, i.e. for example, the frame element 127 and the cap 128 have corresponding latching elements, so that the items are only plugged and latched.

It is also possible that the solution according to the present invention assumes the form of different materials in order to achieve the damping effect and the customization by laser-etching. Here, the base part 124 is entirely formed of the elastic material 45, and the further material 46 forms the cap 128.

Figure 28:
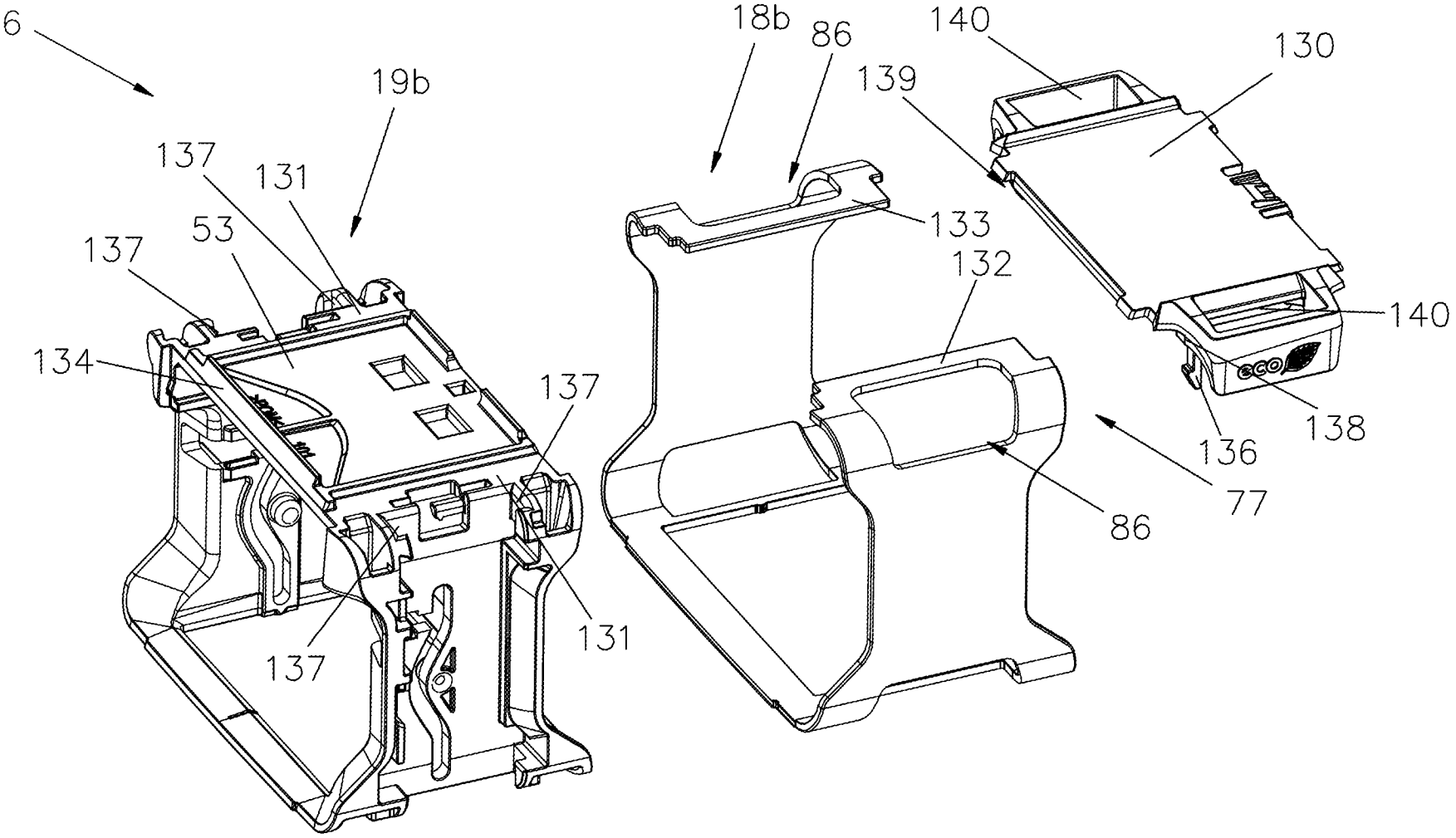
FIG. 28—exploded view of the bottom part for an embodiment of a fastening of the metal part on the plastic part via a cover plate.
Figure 30:
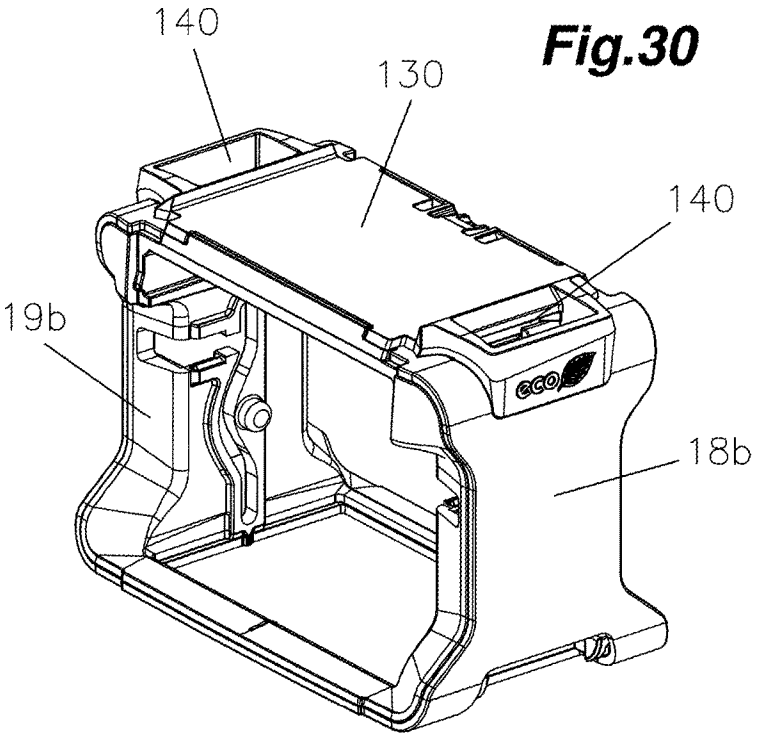
FIG. 30—schematic illustration of the bottom part of FIG. 29 with attached or mounted cover plate.
Figure 29:
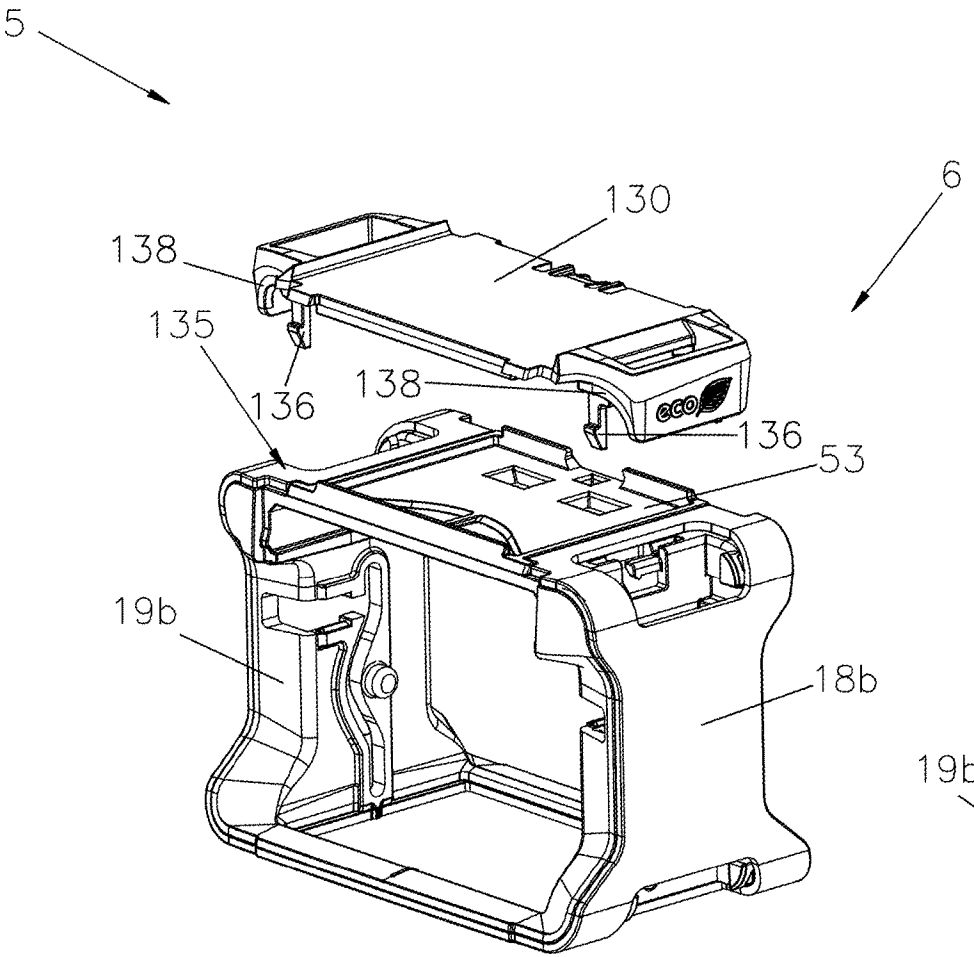
FIG. 29—schematic illustration of the bottom part of FIG. 28 with attached metal part on the plastic part.

In FIGS. 28 to 30, an exemplary embodiment of the design of the bottom part 6 is shown, wherein the bottom part 6 is now made of three parts, namely the metallic part 18*b*, the plastic part 19*b* and a cover plate 130. The metal piece 18*b* is in turn formed o-shaped 77, so that fastening on the surface 53 of the plastic part 19*b* is affected. For this purpose, guide recesses 131 are provided on the surface 53, into which the two ends 132, 133 of the metal part 18*b* can be pushed in, so that these rest in the guide grooves 131 and are positioned. To ensure that upon fitting of the metal part 18*b* on the plastic part 19*b* the metal part 18*b* is positioned correctly during the positioning, a stop surface 134 is provided on the surface 54 of the plastic part 19*b*, so the metal part 18*b* can be pushed up to this stop surface 134. In the contact region 135 to the stop surface 134, the ends 132, 133 have appropriate graduations, so that a positive-fit abutment is ensured.

An illustration of this kind, with the plastic part 19*b* fitted on the metal part 18*b*, is shown in FIG. 29, wherein the cover plate 130 is not mounted yet. It can also be seen clearly that the O-shaped metal part 18*b* rests on and is thus attached to the surface 53, rather than, as known from the prior art, the lateral surfaces of the plastic part.

For fastening of the cover plate 130, the metal part 18*b* in turn comprises the receiving opening 86, through which the corresponding fastening and locating means can be inserted to engage in the plastic part 19*b*. To this end, on the cover plate 130 latching elements 136 are arranged, while on the plastic part 19*b* corresponding latching openings 137 are arranged, so that the latching elements 136 can be positioned or inserted, respectively, into the corresponding latching openings 137 on the plastic part 19*b* through the receiving opening 86. For proper positioning of the frame, in particular the metal part 18*b*, additional guiding frames 138 are arranged on the cover plate 130, which bear on the edge of the receiving openings 86 and thus position the metal part 18*b*.

Furthermore a recess 139 is provided on the cover plate 130, which, when the cover plate 130 is fitted, receives the stop surface 134 and thus creates a fine closure, as is apparent from FIG. 30, in which all three elements of the bottom part 6, namely the metal part 18*b*, the plastic part 19*b* and the cover plate 130, are assembled. In the assembled state it can also be clearly seen how the cover plate 130 fixes and embeds the metal part 18*b* on the surface 53. However, for the bow-shaped top part 3 consisting of the metal part 18*a* and the plastic part 19*a* to be mountable on the bottom part 6, the cover plate 130 comprises receiving openings 140 through which the upper element 3 is inserted, so that it is fixed in the bottom part 6 and a stamp 1 can be created according to the previously described figures.

Thus it can be said that contrary to the embodiment described above, now the metal part 18*b* is no longer directly connected to or fastened on the plastic part 19*b* of the bottom part 6, but the metal part 18*b* of the bottom part 6 is fixed or connected, respectively, via the cover plate 130 on the plastic part 19*b* of the bottom part 6.

Furthermore, FIGS. 31 to 39 show further improved embodiments for the latch 23, where the latch 23, in particular the locking clip 36, bears on a return spring 145, so by the force of the return spring 145 on the latch 23 in the resting position of the stamp 1 the same is arranged in a defined position, in which the latch 23 is inactive.

In the illustrated stamp 1, the latch 23 is formed by a locking clip 36, formed in the bow-shaped top part 4 and used to fix the top part 3 on the bottom part 6 by the engagement of the latching hooks 40, where, however, the design of the latch 23 according to the present invention with a return spring 145 can be used for other stamp constructions, such as an office stamp with central strut, in which the latch is arranged in a central strut. The basic structure and function of the locking clip 36 is similar to the embodiments described above, so that it can be taken from the same and will not be reiterated here.

To enable use of the return spring 145, a receiving surface 146 is arranged on the latch 23, on which one end of the return spring rests 145, while the other end of the return spring 145 is formed on a support surface 147 or in one piece with the spring element 27, as subsequently described. The receiving surface 146 may in this case simply comprise an appropriately large area for receiving the preferably circular-shaped return spring 145, or, for example, a semi-spherical elevation may be arranged on the receiving surface 146 for centering of the return spring 145 that fits into the interior of the circular return spring 145. It is also possible that around the receiving surface 146 elevations (not shown) are arranged, so that the return spring 145 can be inserted in between, and thus lateral guidance is present.

By the return spring 145 it is now achieved that in the inactive state, i.e. in the resting position, the latch 23 is always pressed into or arranged in, respectively, a defined position, i.e. the return spring 145 presses the barrier, in particular the locking clip 36, against the support surface 147, preferably upwards, so that the latching hooks 40 are disengaged, in particular within the bow-shaped top part 4. Thus it is prevented that during a forceful stamping process the latch 23 independently comes into contact with the bottom part 6 and the stamp 1 is locked by itself due to a slight rotational or translational movement process.

Figure 34:
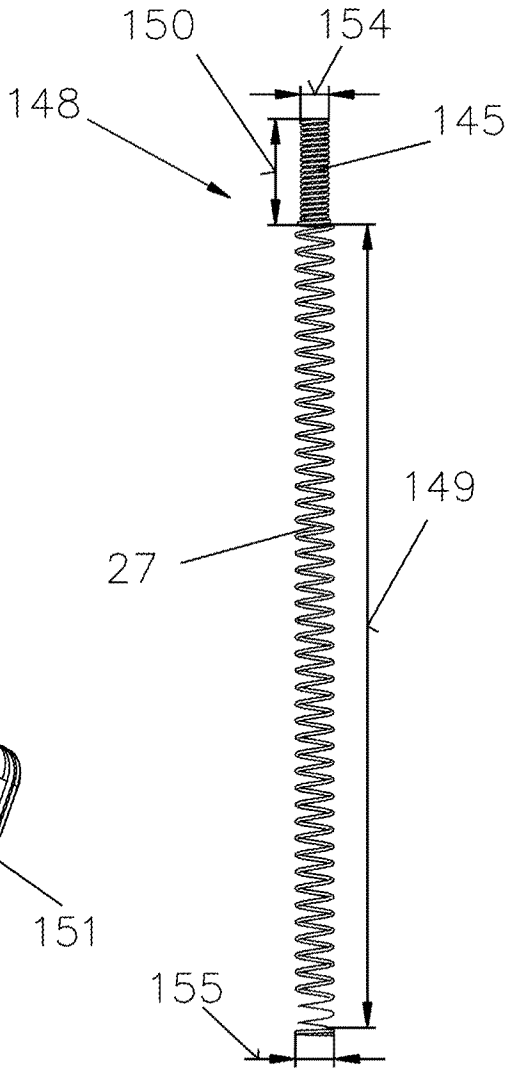
FIG. 34—a one-piece spring with the function of the return spring for the latch and the spring element for the stamp.
Figure 33:
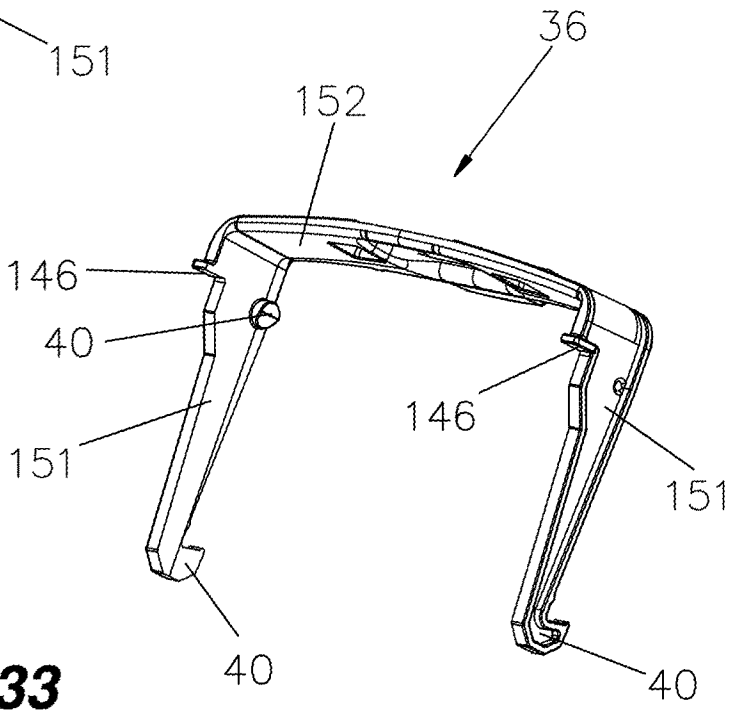
FIG. 33—another view of the latch of FIG. 32.
Figure 32:
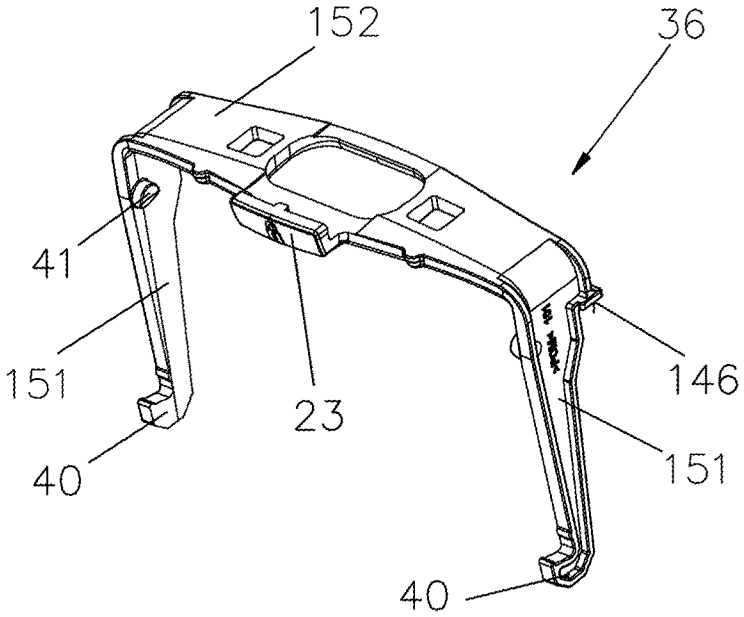
FIG. 32—another embodiment of the latch with a return spring in combination with the spring element of the stamp.
Figure 36:
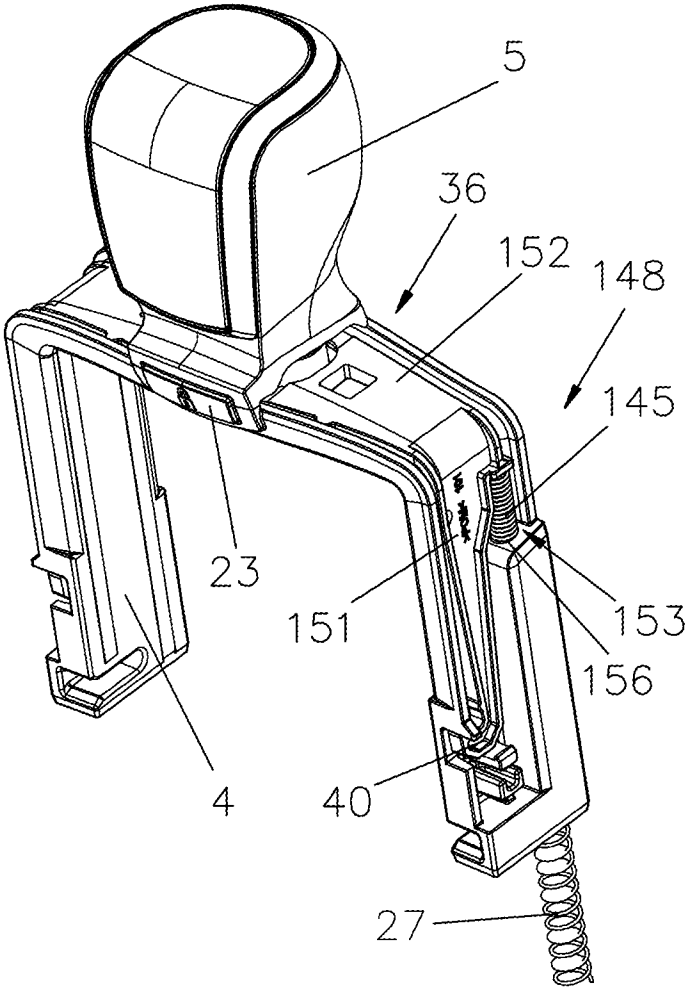
FIG. 36—illustration of the top part of the stamp with the latch and the one-piece spring.
Figure 35:
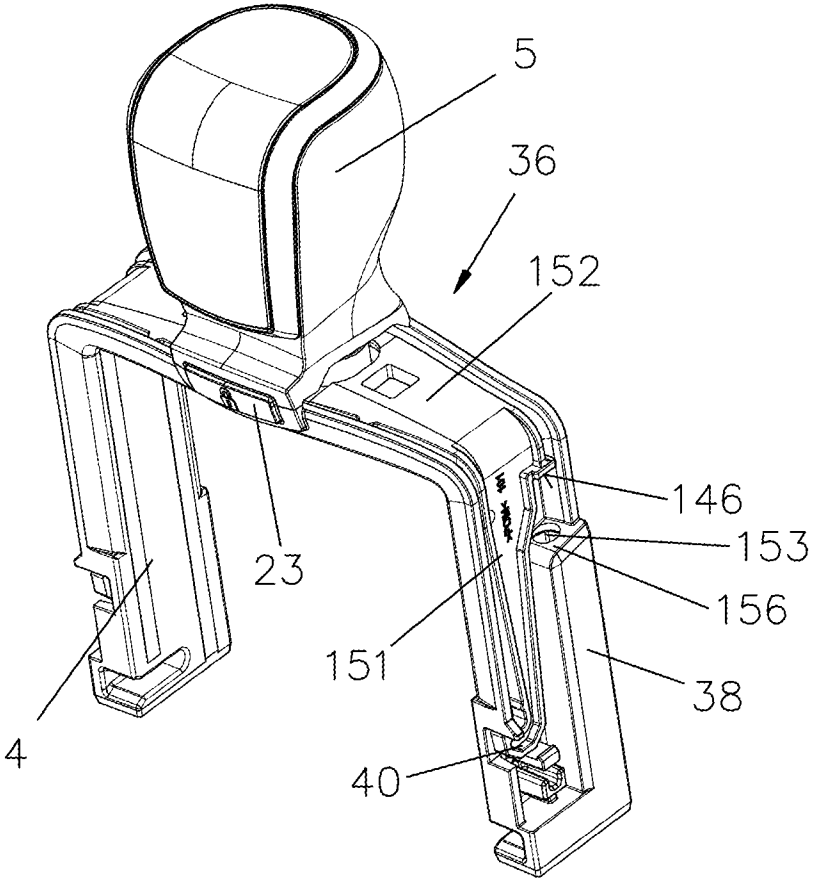
FIG. 35—illustration of the top part of the stamp with inserted latch according to FIGS. 32-34.

In FIGS. 32 to 38, now an embodiment is shown in detail in which a spring 148 for the stamp 1 is formed in one piece and by the spring elements 27 and the return spring 145, i.e. the spring 148 is formed from two individual parts having different tasks, wherein the spring element 27 is responsible for the return of the stamp 1 into the resting position 13 and the return spring 145 for that of the latch 23 into a defined position in the top part 4. As shown in FIG. 34, here the spring element 27 is formed over a length 149, while the return spring 145 has a length 150. Furthermore, the two areas, i.e. the spring element 27 and the return spring 145, have different windings, where due to the formation of the windings corresponding force ratios can be adjusted or defined, respectively.

Figure 31:
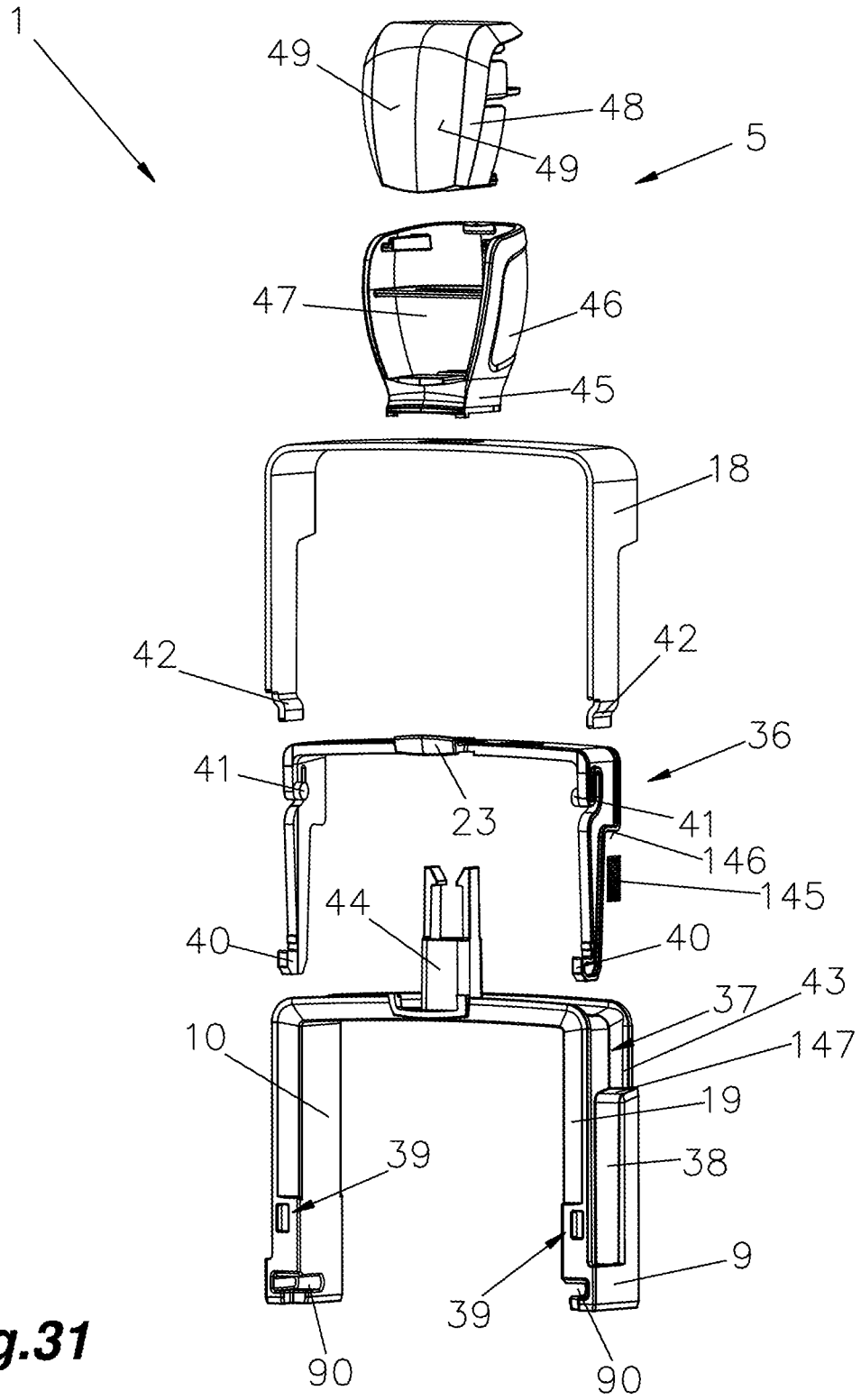
FIG. 31—embodiment of a new latch with a return spring.

In contrast to the locking clip 36 shown in FIG. 31, the locking clip 36 in FIGS. 31 to 36 comprises an enlarged receiving surface 146, so that the return spring 145 can be better positioned. Hence it is also possible to use additional means for positioning, if necessary. Here the receiving surface 146 is arranged at the lateral elements 151, whereas in the embodiment of FIG. 39 the receiving surface 146 and the return spring 145 are arranged in the transverse element 152 connecting the lateral elements 151. Furthermore, it is shown in the illustration that the pivot pins 41 are also arranged on the lateral elements 151, via which the locking clip 36 is pivoted or rotated by actuating the latch 23, so that the latching hooks 40 arranged at the end of the lateral elements 151 are moved or pivoted, From FIG. 33 it can be seen how the locking clip 36 is installed into the bottom part 6, where the receiving surface 146 is arranged in the direction of the receiving element 38 of the spring element 27. To enable insertion of the one-piece spring 148, consisting of the areas of the spring element 27 and the return spring 145, on the receiving element 38 an opening 153 is arranged that matches the diameter 154 of the return spring 145, whereas a diameter 155 of the spring element 27 is larger, so that the spring element 27 is supported in the region of the opening 153 of the receiving element 38, i.e., an end surface 156 of the receiving element 38 with the opening 153 arranged therein is designed for supporting the spring element 27, as can be seen from FIG. 34, into which the spring 148 is installed.

Figure 38:
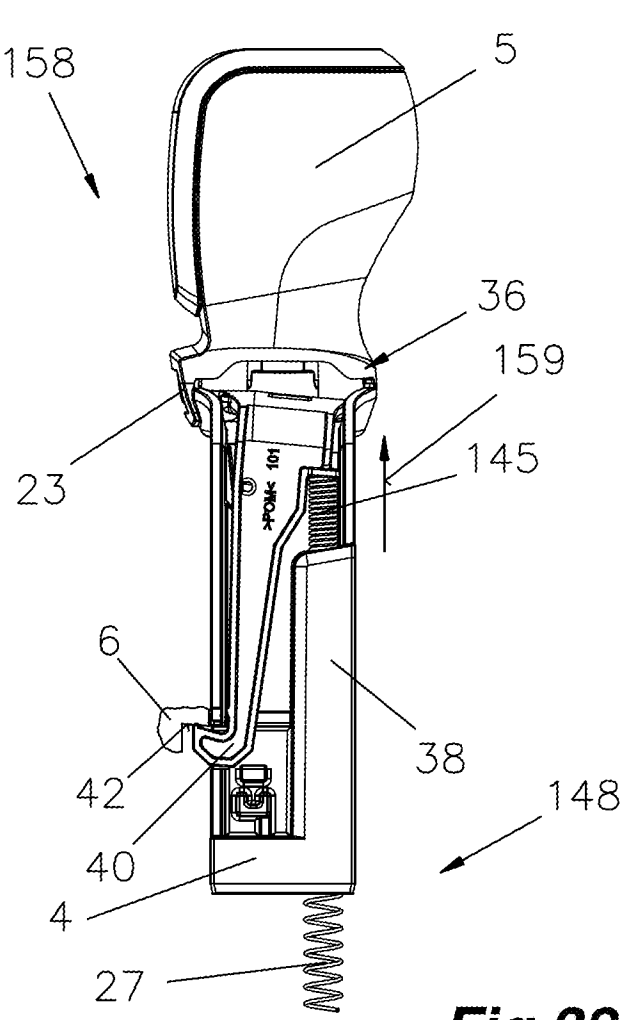
FIG. 38—lateral view of the exemplary embodiment of the latch with the one-piece spring of FIGS. 32 to 37 in the active position, i.e. the pressed and latched position for fixing the top part to the bottom part of the stamp.
Figure 37:
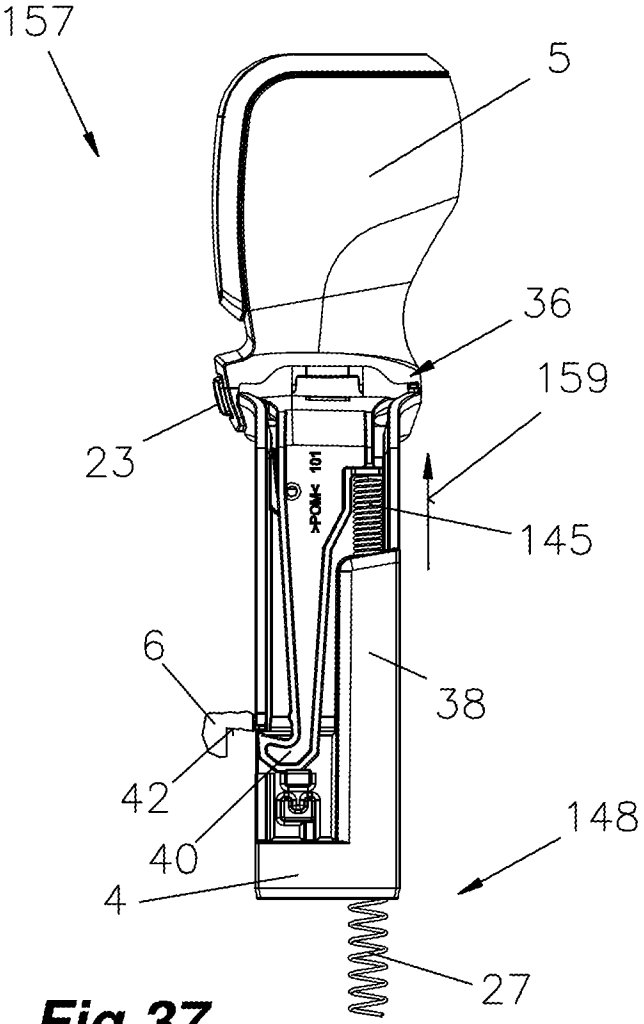
FIG. 37—lateral view of the exemplary embodiment of the latch with the one-piece spring of FIGS. 32 to 36 in the inactive position, i.e. the resting position.
Figure 39:
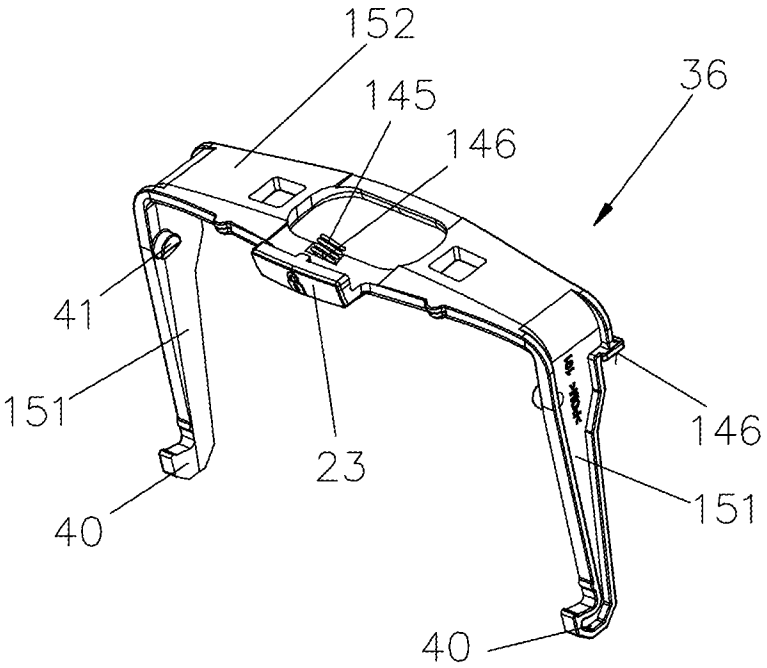
FIG. 39—another exemplary embodiment of the latch with the return spring in a different position.

In FIGS. 37 and 38 the mode of operation of the latch 23 (e.g., spring-operated), in particular of the locking clip 36, can be seen. Here, in FIG. 37 an inactive position 157 is shown, where the latch 23 is in the resting position, while in FIG. 38 an active position 158, where the latch 23 was engaged, is shown in the assembled state of the stamp 1 in engagement with the bottom part 6. From the inactive position 157 it can be seen that the return spring 145 of the spring 148 exerts a force onto the receiving surface 146 in the direction of an arrow 159, so that the locking clip 36 is pushed upward in such a manner that the latching hooks 40 are located within the top part 4 and thus cannot come into engagement with the bottom part 6. In the active position 158, the latch 23 has been actuated, so that against the force of spring 148, in particular of the return spring 145, as shown by the arrow 159, the locking clip 36 has been pivoted around the pivot shaft 41, so that the latching hooks 40 protrude from the top part and latch in the assembled stamp 1 in the bottom part 6 when the stamp 1 is accordingly compressed.

Here, due to the forces from the return spring 145 and the spring element 27 the locking clip 36 and the top part 4 tend to return to the inactive position 157 and the resting position 13, so that the latching hooks 40 reliably engage in the corresponding latching surfaces 42 and the stamp 1, in particular the top part 4 to the bottom part 6, is secured or held in this position, as shown schematically in FIG. 38. It is possible that such a stamp 1 can have several latching positions.

To release the locked position a so-called self-unlocking is performed by the stamp 1 being simply compressed just a bit, so that the latching hook 40 disengages from the latching surface 42 and thus by the force of the spring 148 first the locking clip 38 is independently moved into the inactive position 157, and subsequently the stamp 1, in particular the top part 4 to the bottom part 6, is placed in the resting position 16, when the user does not exert pressure on the stamp 1 anymore.

Figure 41:
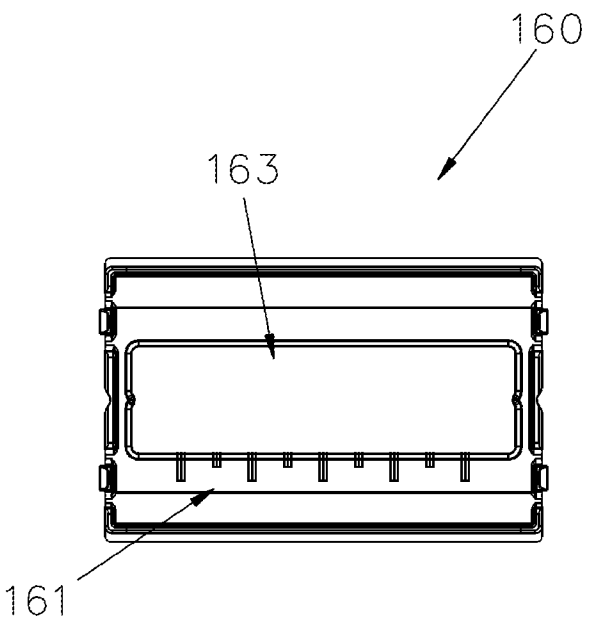
FIG. 41—plan view of the positioning frame of FIG. 40.
Figure 40:
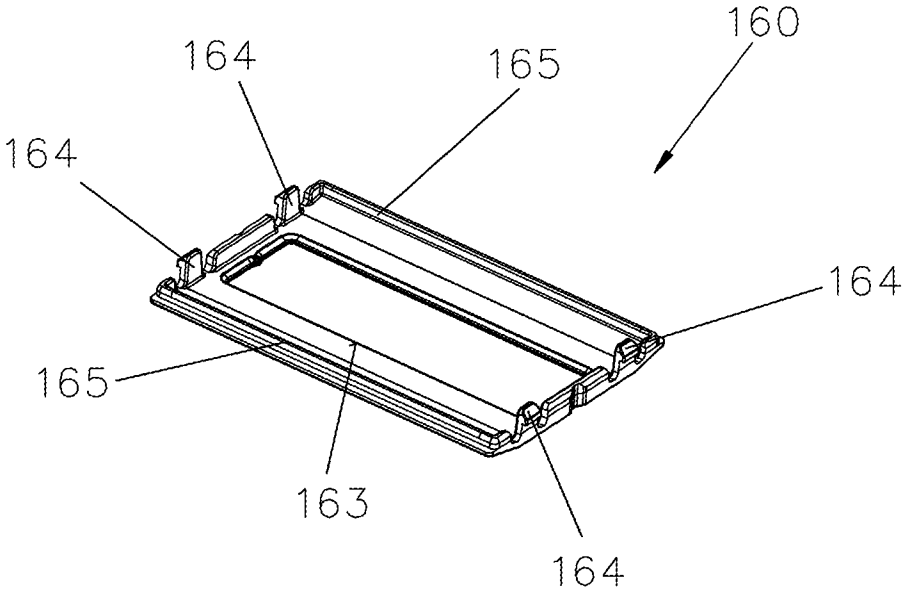
FIG. 40—schematic illustration of a positioning frame for the stamp for reducing the stamp surface.
Figure 43:
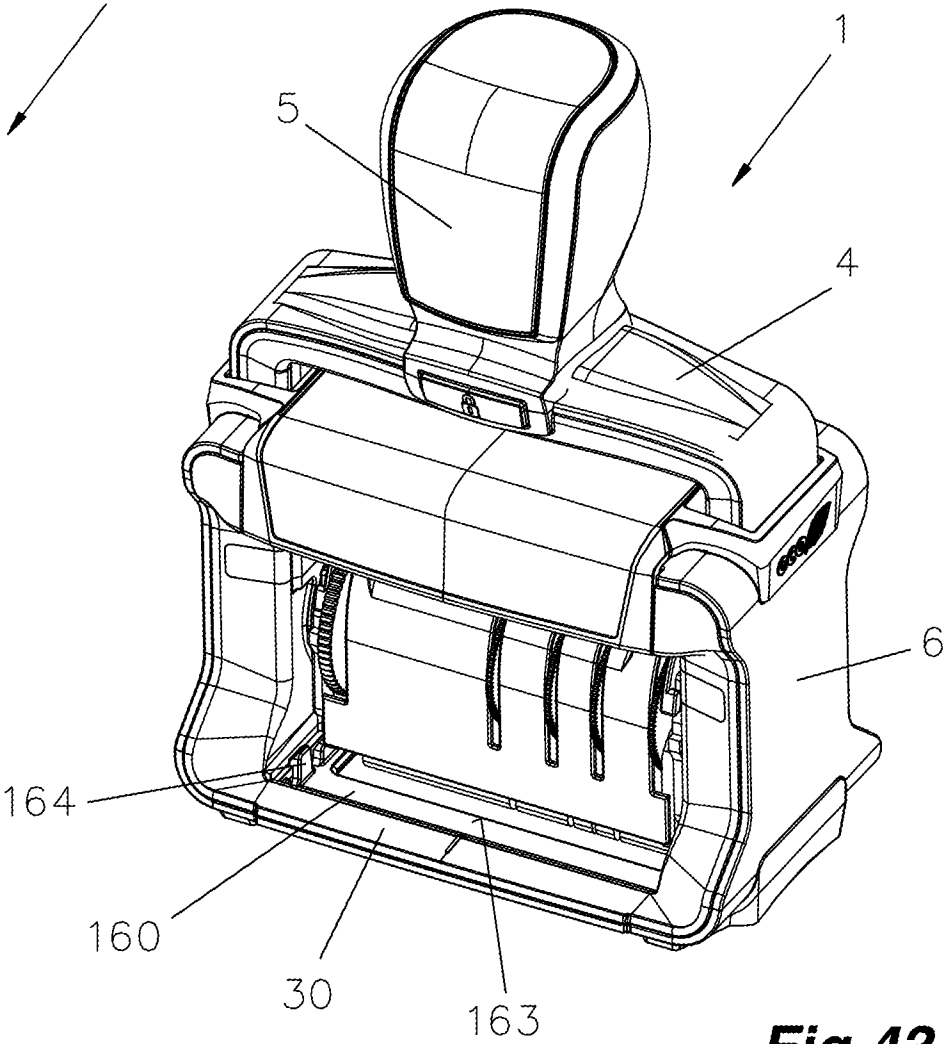
FIG. 43—schematic illustration of the stamp for positioning with inserted positioning frame.

In FIGS. 40 to 43, an embodiment of a novel positioning frame 160 is shown, where FIG. 41 shows a further variant of the positioning frame 160 with a means for positioning 161, in particular a positioning ruler. Here it is possible that also other means for positioning 161 can be indicated to facilitate the positioning of the stamp 1.

Figure 42:
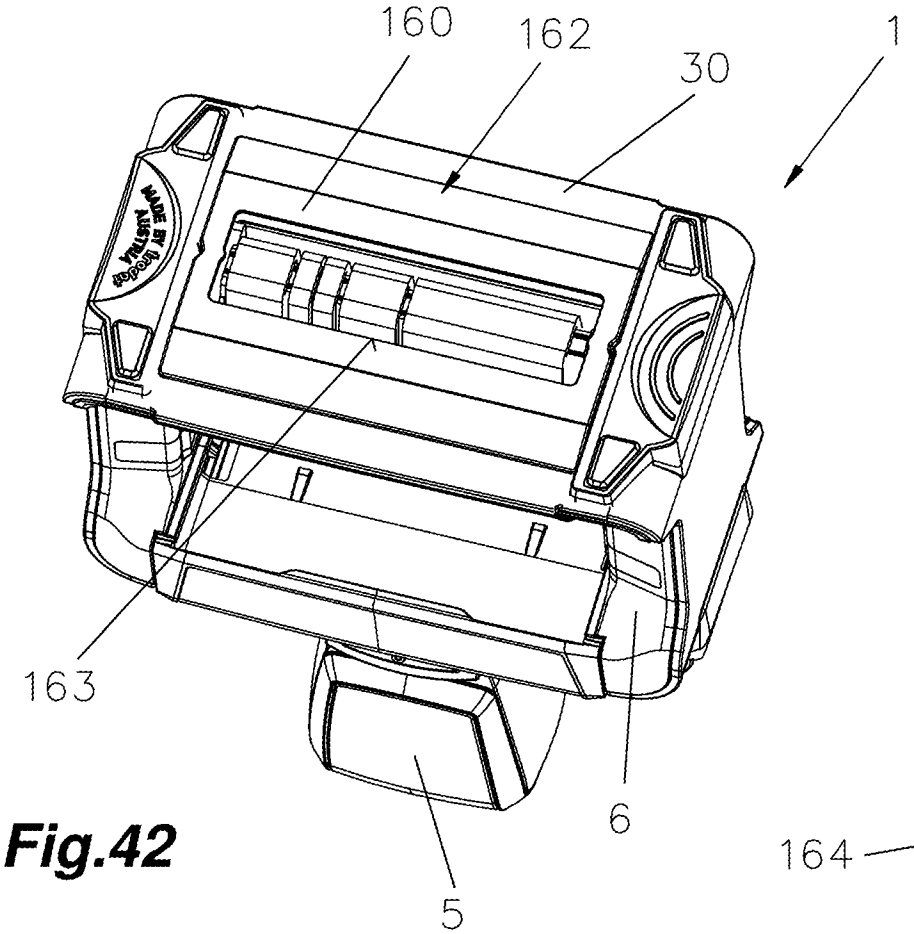
FIG. 42—schematic illustration of the stamp from the bottom with positioning frame inserted as shown in FIGS. 40 and 41.

The positioning frame 160 ensures that an inner area 162 of the stamp 1, in particular the frame 30, is reduced in size, wherein the positioning frame 160 comprises a stamp hole 163 to this purpose, through which for example stamping with the mounted band unit 19 can be done. For the purpose of attaching the positioning frame 160 to the stamp 1, the same comprises several latching elements 164, so that the positioning frame 160 is easily plugged or pluggable onto the underside of the stamp 1, in particular the frame 30, as shown in FIG. 42. Furthermore, it is possible that for improving stability a reinforcing strip 165 is provided, which is arranged in between, in particular in the inner area 162 of the frame 30.

It often occurs in the case of such a stamp 1 that the stamp 1 is used as a pure date stamp 1 with the mounted band unit 19, whereby the positioning of the stamp 1 with a very large stamp area, especially inner area 162, which is usually designed for a text plate 15 and the mounted band 19, becomes very difficult because only a small area, in particular only one line of the mounted band unit 19, must be positioned. If, on the other hand, the positioning frame 160 is mounted, the stamp area, especially the inner area 162, is reduced by the positioning frame 160 to the stamp opening 163 of the positioning frame 160, so that e.g. only this single date line has to be positioned, i.e. a reduction of the stamp area is performed by plugging on the positioning frame 160, so that the smaller stamp opening 163 facilitates a simple positioning, as is apparent from FIGS. 42 and 43.

Furthermore, the positioning frame 160 has the additional advantage that various positioning means 161, such as a ruler, arrows, etc., can be imprinted onto the same or integrated directly into the device, greatly facilitating positioning. It is also possible that in case of smaller text plates 15, e.g. a single line, such a positioning frame 160 for this area, particularly two lines for one line of the text plate and one line for the mounted band unit 19, can be used, for which purpose only the stamp hole 163 is to be adapted.

The positioning frame 160 thus has the objective of reducing in size the area between the frame 30, which is usually fully used for the size of the text plate 15, in order to be able to precisely position the stamp 1. Preferably, the positioning frame 160 is made of a transparent material to enable the user to see the background through the positioning frame 160 when placing the stamp 1, so alignment is easily possible.

As in the previously described embodiments of FIGS. 1 to 43 a stamp 1 is made of a combination of metal and plastic and the metal parts and metal elements 19, in particular the top part 19*a* and bottom part 19*b*, are arranged visibly, i.e. on the external surfaces of the stamp, upon delivery from the manufacturer these are provided with a protective film (not shown). The objective of the protective film is to prevent fingerprints and other contaminations from soiling the metal parts 19 in the production of the stamp 1. Upon receipt of his/her stamp 1, the customer may easily remove this protective film by pulling it off. Such protective films may also be placed on other parts, such as the handle element 5 or the window element 51.

As a matter of form, it should finally be emphasized that, for the better understanding of the structure of the system 1 and its components and their constituent parts, the same have in part been represented not to scale and/or enlarged and/or reduced in size.

In addition, individual features or feature combinations from the various exemplary embodiments shown and described can inherently form independent inventive solutions or solutions according to the invention.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A stamp, in particular a self-inking stamp, comprising at least one stamping component and one stamping insert, wherein the stamping component is formed of a top part with a handle element and a bottom part with an ink pad, wherein the top part is designed bow-shaped and the stamping insert is connected so as to move synchronously via a reversing mechanism having a slide track in the bottom part via a shaft or trunnion to the top part, wherein in the resting position a text plate mounted on the stamping insert abuts against the ink pad in a support device of the ink pad, and that in a stamping process for producing a stamp imprint in the stamping position the stamping insert with the text plate is shiftable by the reversing mechanism into a stamping position, wherein the ink pad is positioned, during use, in an opening in a first side of the support device such that the ink pad is in direct contact with sidewalls of the opening in the first side of the support device, wherein a first sidewall of the opening is part of a protective cover, wherein a handle element is attached to a side of the protective cover opposing the first sidewall of the protective cover that is in direct contact with the ink pad in the opening, wherein the protective cover extends in a direction, orthogonal to the handle element, towards a contact area of the stamp with an edge of the protective cover extending beyond both a contact surface of the ink pad and edges of the three remaining sidewalls of the opening in the support device.

2. The stamp according to claim 1, wherein the protective cover extends over an entire longitudinal side of the ink pad.

3. The stamp according to claim 1, wherein in an area of the support device the bottom part of the stamp is formed to be open in a direction of the stamping insert, where the ink pad is arranged to be supported on guide bars on either side of the bottom part.

4. The stamp according to claim 1, wherein the support device comprises an angular surface, having attached a means for fastening of the ink pad during use.

5. The stamp according to claim 1, wherein the handle element is attached to the protective cover on the support device of the ink pad such that the handle element extends away from the support device and the ink pad.

6. The stamp according to claim 1, wherein the protective cover is integrally formed as the first sidewall of the opening.

* * * * *